US011377885B2

(12) United States Patent
Bacon

(10) Patent No.: US 11,377,885 B2
(45) Date of Patent: Jul. 5, 2022

(54) LEVER ACTUATED LATCH ASSEMBLY

(71) Applicant: BAUER PRODUCTS, INC., Grand Rapids, MI (US)

(72) Inventor: Bruce C. Bacon, Rockford, MI (US)

(73) Assignee: BAUER PRODUCTS, INC., Grand Rapids, MI (US)

( * ) Notice: Subject to any disclaimer, the term of this patent is extended or adjusted under 35 U.S.C. 154(b) by 1120 days.

(21) Appl. No.: 15/951,892

(22) Filed: Apr. 12, 2018

(65) Prior Publication Data

US 2019/0316391 A1 Oct. 17, 2019
US 2020/0291695 A9 Sep. 17, 2020

(51) Int. Cl.

| | |
|---|---|
| ***E05B 85/16*** | (2014.01) |
| ***E05B 55/00*** | (2006.01) |
| ***E05B 85/22*** | (2014.01) |
| ***E05B 83/44*** | (2014.01) |
| ***E05B 85/12*** | (2014.01) |
| ***E05B 77/30*** | (2014.01) |
| ***E05B 7/00*** | (2006.01) |
| ***E05B 63/16*** | (2006.01) |

(52) U.S. Cl.

CPC ..... *E05B 85/16* (2013.01); *E05B 55/005* (2013.01); *E05B 77/30* (2013.01); *E05B 83/44* (2013.01); *E05B 85/13* (2013.01); *E05B 85/22* (2013.01); *E05B 7/00* (2013.01); *E05B 63/16* (2013.01)

(58) Field of Classification Search

CPC ..... E05B 85/16; E05B 55/005; E05B 83/44; E05B 63/16; E05B 7/00; E05C 1/00; E05C 1/085; E05C 1/14

USPC ..... 292/137, 138, 140, 159, 150

See application file for complete search history.

(56) References Cited

U.S. PATENT DOCUMENTS

| | | | | |
|---|---|---|---|---|
| 1,964,066 | A * | 6/1934 | Kuszmaul | E05B 85/22 292/172 |
| 2,427,386 | A * | 9/1947 | Claud-Mantle | E05B 85/22 292/DIG. 31 |
| 2,743,953 | A | 5/1956 | Marra et al. | |
| 4,732,417 | A * | 3/1988 | Yang | E05C 1/14 292/336.3 |
| 6,131,966 | A * | 10/2000 | Hensley | E05B 63/18 70/DIG. 6 |
| 6,309,008 | B1 | 10/2001 | Bacon | |
| D485,155 | S | 1/2004 | Bacon | |

(Continued)

FOREIGN PATENT DOCUMENTS

| | | |
|---|---|---|
| EP | 2278102 | 1/2011 |

*Primary Examiner* — Kristina R Fulton
*Assistant Examiner* — Matthew Thomas Evanko
(74) *Attorney, Agent, or Firm* — Price Heneveld LLP

(57) ABSTRACT

A latch assembly comprises an outside housing, a door latch, an external lever handle, a plunger, a resilient member, and a handle cam. The handle cam comprises a cam surface juxtaposed against and in sliding relation with a plunger cam surface. The plunger is maintained in the latched position when the external lever handle is in the retracted position by the resilient member, whereby an entry door cannot be unintentionally shifted from the closed position, and the plunger is displaced from the latched position to the unlatched position when the external lever handle is displaced from the retracted position to the extended position by the cam surface of the handle cam bearing against the plunger cam surface, whereby the entry door is free to be shifted from the closed position to the open position.

46 Claims, 26 Drawing Sheets

(56) References Cited

U.S. PATENT DOCUMENTS

| | | | | |
|---|---|---|---|---|
| 6,685,240 | B2 | 2/2004 | Bacon | |
| 6,701,761 | B1 * | 3/2004 | Chang | E05B 35/08 70/369 |
| 8,186,191 | B2 | 5/2012 | Bacon | |
| 8,347,667 | B2 | 1/2013 | Bacon | |
| 8,393,187 | B2 | 3/2013 | Bacon | |
| 8,419,089 | B2 | 4/2013 | Bacon | |
| 8,621,901 | B2 | 1/2014 | Bacon | |
| 8,960,733 | B1 | 2/2015 | Smith | |
| 9,085,919 | B2 | 7/2015 | Bacon | |
| 9,145,713 | B1 | 9/2015 | Norris | |
| 9,940,767 | B2 | 4/2018 | Bacon | |
| 2013/0097938 | A1 * | 4/2013 | Madrid | E06B 3/70 49/506 |
| 2013/0098124 | A1 * | 4/2013 | Williams | E05B 7/00 292/210 |
| 2015/0330108 | A1 | 11/2015 | Harrison | |
| 2016/0017638 | A1 * | 1/2016 | Dore Vasudevan | E05B 55/12 292/137 |
| 2017/0030107 | A1 * | 2/2017 | Naka | E05B 15/0006 |
| 2018/0016810 | A1 | 1/2018 | Bacon | |

* cited by examiner

LEVER ACTUATED LATCH ASSEMBLY

BACKGROUND OF THE INVENTION

The present invention relates to latch assemblies for movable closures and the like, and, in particular, to a latch assembly for a recreational vehicle that can be manually actuated by a lever.

Latch assemblies are generally well-known in the art, and may be flush mounted on an associated closure, such as a door, to facilitate selectively shifting the closure between an open unlocked position and a closed locked position. Paddle handle assemblies are used widely on entry doors as latch assemblies for recreational vehicles, motor homes, and the like, and in such applications require that the latch mechanism be accessible and operable from both the inside and the outside of the vehicle. Typically, such paddle handle assemblies include a deadbolt lock for added security.

Heretofore, while paddle handle assemblies have proven generally effective, they experience certain drawbacks. For example, it is sometimes difficult for a user to obtain a positive grip with certain paddle handle assemblies, particularly in the case of a left-handed person operating a paddle handle assembly mounted on the left side of the door exterior or a right-handed person operating a paddle handle assembly mounted on the right side of the door exterior, where the paddle handle is extending in the direction opposite that of the user's favored hand. Also, some prior art paddle handle assemblies experience a problem in maintaining the alignment between the deadbolt and the associated strike. Further, it is sometimes difficult to lock a paddle handle assembly from the exterior. In addition, many prior art paddle handle assemblies have a rather complicated construction, which is expensive to manufacture and difficult to repair. Hence, a latch assembly that overcomes these drawbacks would be advantageous.

SUMMARY OF THE INVENTION

One aspect of the present invention is a latch assembly adapted for mounting adjacent an associated closure of the type that can be shifted between an open position and a closed position. The latch assembly comprises an outside housing having an inner face and an outer face and a door latch disposed proximate a side of the outside housing and adapted to engage a jamb section of the door opening, the door latch having a door open position and a door closed position. An external lever handle has a first end and a second end, wherein the first end is operably coupled with the door latch and the second end is pivotally mounted on the outer face of the outside housing for rotation of the external lever handle between a retracted position and an extended position. A plunger is slidingly received within a plunger recess disposed proximate the inner face of the outside housing and operably connected with the latch assembly, wherein the plunger has a latched position and an unlatched position within the plunger recess and comprises a longitudinal slot within which a plunger cam surface is disposed. A resilient member is operably coupled with the plunger and urges the plunger to the latched position. A handle cam is operably coupled with the first end of the external lever handle, wherein the handle cam is received within the longitudinal slot of the plunger and the handle cam comprises a cam surface juxtaposed against and in sliding relation with the plunger cam surface. The plunger is maintained in the latched position when the external lever handle is in the retracted position by the resilient member, whereby the closure cannot be unintentionally shifted from the closed position, and the plunger is displaced from the latched position to the unlatched position when the external lever handle is displaced from the retracted position to the extended position by the cam surface of the handle cam bearing against the plunger cam surface, whereby the closure is free to be shifted from the closed position to the open position.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
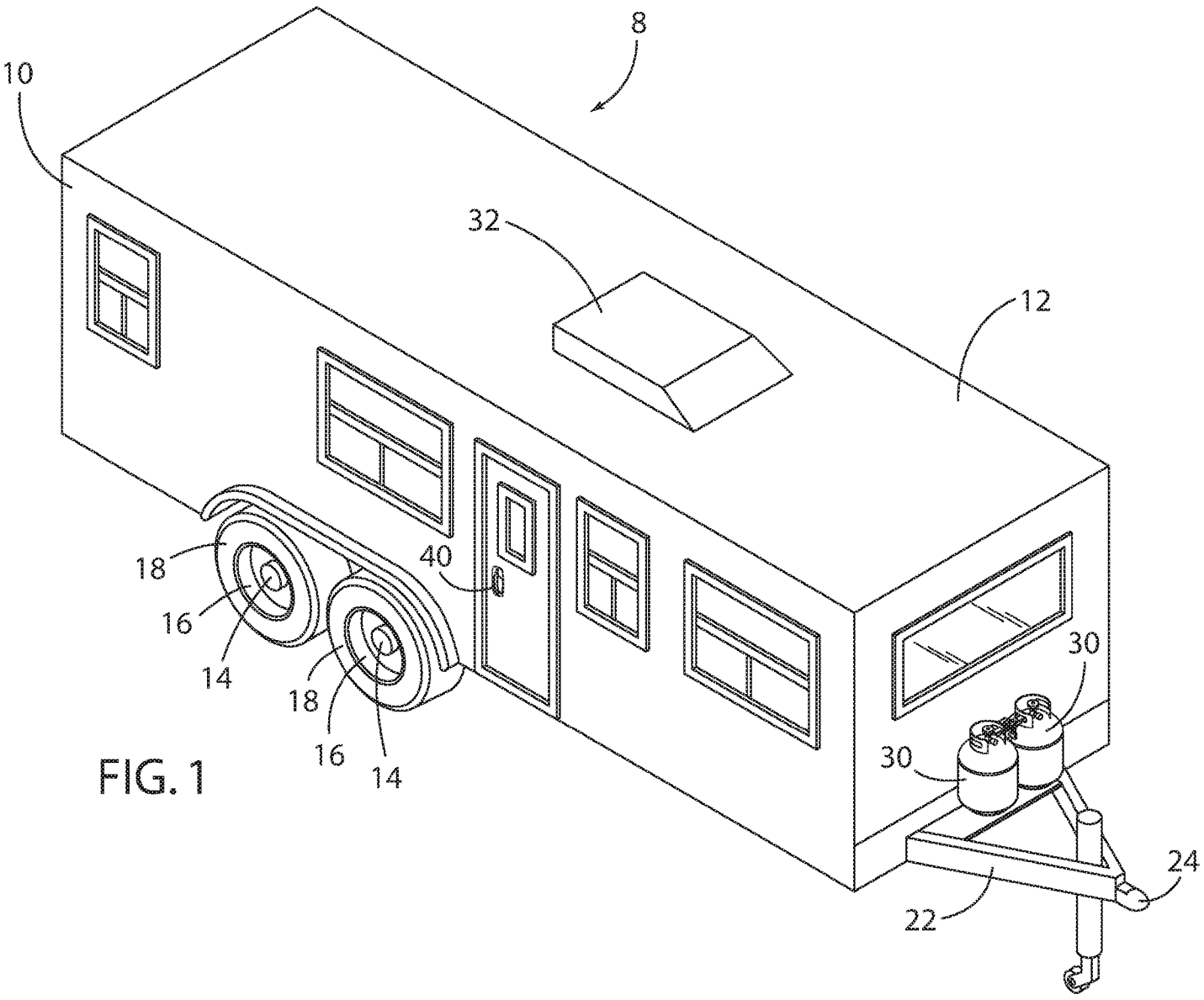
FIG. 1 is a front side perspective view of a recreational vehicle provided with a plurality of ceiling vents on a roof portion thereof.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, reference numeral 8 generally designates a recreational vehicle travel trailer particularly adapted for being towed by a motor vehicle (not shown). However, other recreational vehicle 8 configurations may advantageously employ the benefits of the present disclosure, such as and including motor coaches and so-called fifth wheel travel trailers. In the embodiment contemplated herein, the recreational vehicle 8 generally comprises a body 10 that is primarily supported by a pair of axles 14, each comprising an axle assembly 16 and at least one pair of opposed road wheels 18, and a trailer tongue 22 and ball 24 by which the recreational vehicle 8 be attached to the tow vehicle. As is typical, the recreational vehicle 8 has a closure or entry door 20 for ingress and egress and a plurality of windows 22 arranged on side walls 24 of the body 10. A roof portion 12 is provided to enclose the body 10. Propane tanks 30 mounted to the trailer tongue 22 may also be included. Also, optionally, an air conditioning unit 32 can be mounted on the roof portion 12.

The reference numeral 40 in the Figures generally designates a latch assembly 40 embodying a first embodiment of the present invention. Latch assembly 40 may be mounted on associated closure 20, and more particularly where the closure 20 is an entry door for a recreational vehicle 8, as shown, as well as on a motor home, trailer, shed, or the like, wherein the closure 20 can be pivotally shifted between open and closed positions along a substantially vertical hinge axis. For purposes of the present disclosure, the closure 20 will be referred to as the entry door 20. However, it is to be understood that the closure 20 can also include closures for other applications, and closures other than doors, such as hatches and the like.

Figure 2:
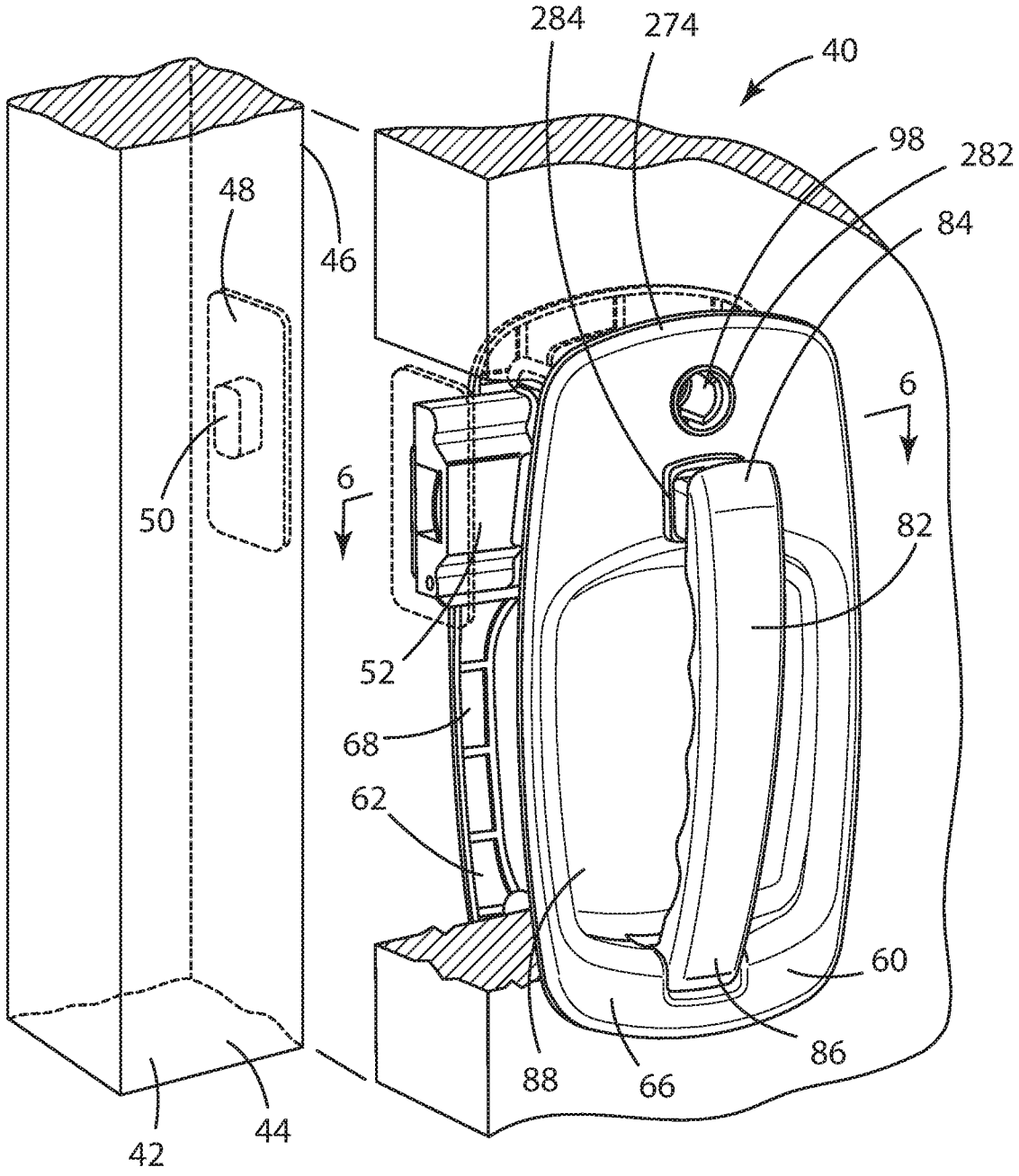
FIG. 2 is a perspective exterior view of a first embodiment of the latch assembly of the present disclosure, shown with the door latch in an unlatched position.
Figure 4:
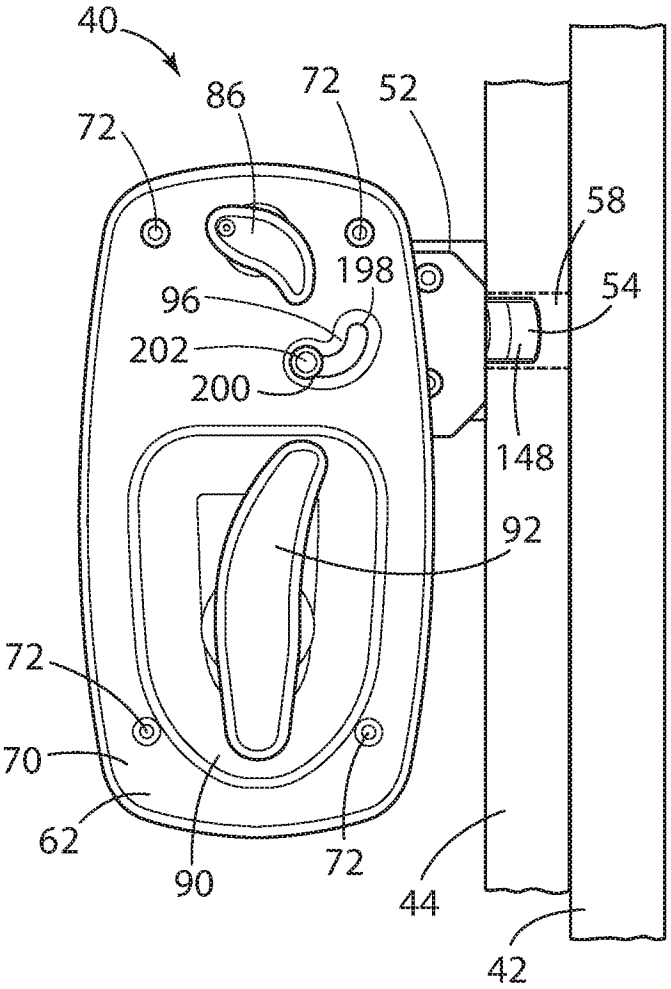
FIG. 4 is interior elevation view of the first embodiment of the latch assembly of the present disclosure shown in FIG. 2.
Figure 3:
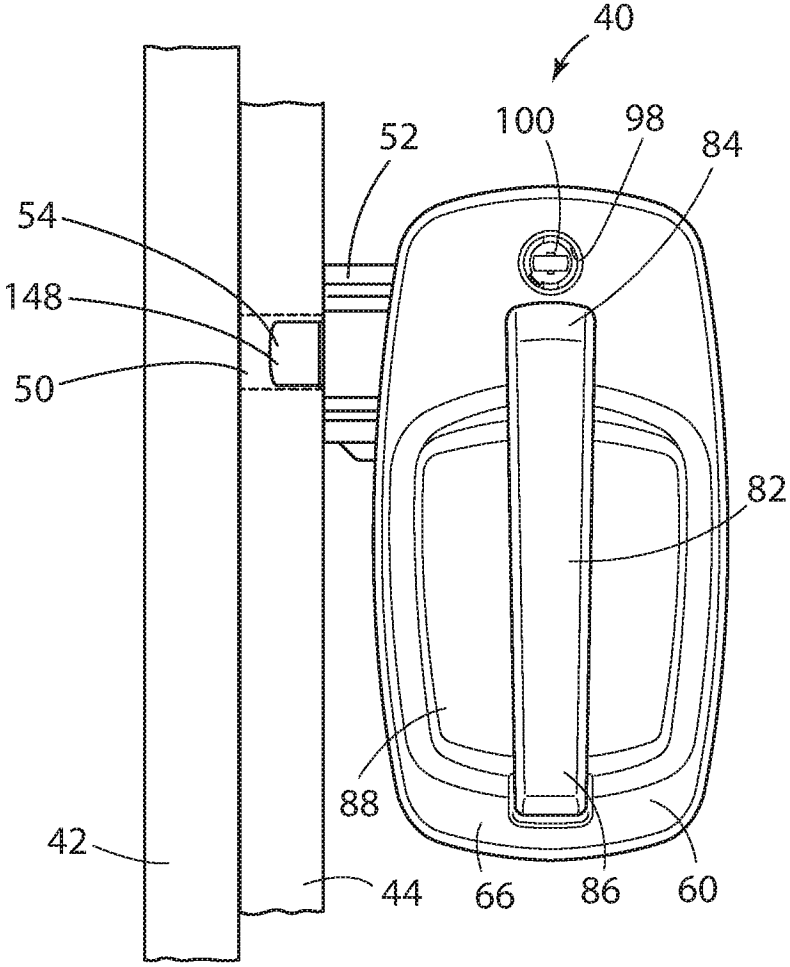
FIG. 3 is an exterior elevation view of the first embodiment of the latch assembly of the present disclosure shown in FIG. 2.

As shown in FIG. 2, entry door 20 selectively engages a doorframe 42 having a jamb section 44 that defines an associated door opening 46 and in which a door strike 48 is mounted. The door strike 48 includes a horizontally extending recess 50 extending into the jamb section 44 into which an associated portion of a door latch 52 (such as a spring bolt 54) and deadbolt 56 (if equipped, as shown in FIGS. 15-28) engages and disengages, respectively, to selectively retain the entry door 20 in the fully closed position, as described in greater detail hereinafter. Of course, door strike recess 50 can be a single recess or may be separate recesses where a separate deadbolt 56 is utilized.

As best illustrated in FIGS. 2-13, the latch assembly 40 generally comprises a two-part construction, including an outside housing 60 and an inside plate 62. A left-hand version of the latch assembly 40 is shown in FIGS. 2-9, while the right-hand version is shown in FIGS. 10-13. Otherwise, both versions include the same components.

As shown in the FIGS. 2, 3, 5, 10, 11, and 12, the outside housing 60 has an inner face 64 and an outer face 66. Similarly, the inside plate 62 has having an inner face 68 and an outer face 70, as shown in FIGS. 4, 8, 9, and 13. The inside plate 62 may be preferably attached to the outside housing 60 by fasteners 72 extending through a plurality of openings 74 extending through and disposed about the margin 76 of the inside plate 62 and attached to a plurality of bosses 78 disposed about the margin 80 of the outside housing 60. Thus, the latch assembly 40, as installed, may be deposed on either side of the entry door 20 and received within a through-cavity (as best depicted in FIG. 2) in the entry door 20, where the latch assembly 40 may be accessed from both the exterior and interior of the recreational vehicle 8, as further described below.

An external lever handle 82 is mounted to the outer face 66 of the outside housing 60 and has a first end 84 and a second end 86, wherein the first end 84 is operably coupled with the door latch 52 and the second end 86 is pivotally mounted on the outer face 66 of the outside housing 60 for rotation of the external lever handle 82 between a retracted position and an extended position.

The illustrated outside housing 60 includes a centrally disposed, bowl-shaped external lever handle recess 88 located directly behind the external lever handle 82, which provides finger access to facilitate actuation of the external lever handle 82 between the retracted and extended position. Similarly, the illustrated inside plate 62 includes a centrally disposed, bowl-shaped interior recess 90 directly behind an interior door release control 92, which provides finger access to facilitate rotation of the interior door release control 92 between a latched and unlatched position. Preferably, the inner face 68 of the inside plate 62 further comprises an integral hook 94 disposed proximate the margin 76 thereof adapted to engage and capture a screen door lever (not shown) of a recreational vehicle, as is known in the art.

The marginal upper portion 96 of the outside housing 60 also includes a lock aperture 98 in which an external lock cylinder 100 is mounted. The door latch 52 is disposed proximate a side of the outside housing 60 and inside plate 62 and is adapted to engage the jamb section 44 of the door opening 46, the door latch 52 having a door open position and a door closed position.

A plunger 102 is slidingly received within a plunger recess 104 disposed proximate the inner face 64 of the outside housing 60 and operably connected with the latch assembly 40. Preferably, the plunger recess 104 is integrally formed on the inner face 64 of the outside housing 60. The plunger 102 is adapted to slide and thereby shift between a latched position and an unlatched position within the plunger recess 104 and is provided with a longitudinal slot 106 within which a plunger cam surface 108 is disposed. Preferably, an inside plate 110 is mounted to the inner face 64 of the outside housing 60, wherein the plunger 102 is disposed between the outside housing 60 and the inside plate 110 and is restrained within the plunger recess 104.

A resilient member 112 is operably coupled with the plunger 102 and urges the plunger 102 to the latched position. Preferably, the resilient member 112 is a compression spring having a first end 114 received within a cylindrical cavity 116 disposed within a first end 118 of the plunger 102 and a second end 120 abutting a terminal wall 122 of the plunger recess 104 opposite the first end 118 of the plunger 102.

A handle cam 124 is operably coupled with the first end 84 of the external lever handle 82 and is received within the longitudinal slot 106 of the plunger 102. The handle cam 124 is provided with a cam surface 126 juxtaposed against and in sliding relation with the plunger cam surface 108. Preferably, the longitudinal slot 106 is wider than handle cam 124 in order to allow the handle cam 124 to move transverse to the longitudinal slot 106, as the external lever handle 82 is rotated from the retracted position to the extended position.

The plunger 102 is maintained in the latched position when the external lever handle is in the retracted position by the resilient member 112, whereby the entry door 20 cannot be unintentionally shifted from the closed position. The resilient member 112 that is operably coupled with the plunger 102 also simultaneously acts on the handle cam 124 by urging the plunger 102 to its latched position, thereby retracting the external lever handle 82 to its retracted position. To open the entry door 20, the plunger 102 may be displaced from the latched position to the unlatched position as the external lever handle 82 is displaced from the retracted position to the extended position, whereupon the cam surface 126 of the handle cam 124 bears against the plunger cam surface 108, causing the door latch 52 to shift to the door open position, whereby the entry door 20 is free to be shifted from the closed position to the open position.

The latch assembly 40 preferably may be provided with the interior door release control 92 mounted proximate to the outer face 70 of the inside plate 62. Preferably, the interior door release control 92 is a rotatable lever operably coupled with a cam 128, where a square opening 130 in the cam 128 may be operably coupled with a rotating square shaft 132 of the interior door release control 92. An interior plunger arm 134 may be operably coupled with the plunger 102. Preferably, the interior plunger arm 134 is integral with the plunger 102 and depends therefrom in a substantially perpendicular direction relative to the longitudinal slot 106, as shown in FIGS. 5, 10, 11, and 12. In operation, rotation of the interior door release control 92 from the unlatched to the latched position urges the cam 128 against the interior plunger arm 134 to displace the plunger 102 from the latched position and an unlatched position, thereby moving the latch assembly 40 to the door open position. During this operation, it is preferable that the longitudinal sliding the plunger be provided with sufficient relief to allow the plunger 102 to slide to the unlatched position without contacting the handle cam an axle assembly 16124, as shown in, for example, FIGS. 5, 6, and 7.

The outer face 66 of the outside housing 60 further may also include a lower recess 136 within which the second end 86 of the external lever handle 82 is received. This lower recess 136 may be and preferably is continuous with the bowl-shaped external lever handle recess 88. A hinge pin 138 may be inserted within openings 140 provided in the lower recess and an opening 142 in the second end 86 of the external lever handle 82, whereby the hinge pin 138 extends across the lower recess 136 and through the opening 142 in the second end 86 of the external lever handle 82 to pivotally mount the second end 86 of the external lever handle 82 to the outer face 66 of the outside housing 60 for rotation of the external lever handle 82 between the retracted position and an extended position. Optionally, as handle hinge spring 144 may be disposed about the hinge pin 138 and adapted to urge the external lever handle 82 to the retracted position. Preferably, if so provided, the handle hinge spring 144 is a torsion spring.

The lock aperture 98 may be provided through the outside housing 60 through which the external lock cylinder 100 extends from the outer face 66. The external lock cylinder 100 has a locked condition and an unlocked condition, as further discussed below.

In operation, the entry door 20 can be shifted from the closed to the open position from the exterior of the recreational vehicle 8 in the following manner. With the latch assembly 40 in the unlocked position, the external lever handle 82 may be rotated outwardly from the retracted position to the extended position. Rotation of the external lever handle 82 from the retracted position to the extended position displaces the handle cam 124 outwardly, which, in turn, shifts the plunger 102 laterally inwardly. The lateral inward shifting of the plunger 102 causes the door latch 52 to shift to the unlatched position. The door latch 52 thereby disengages from the door strike recess 50, and permits the user to shift the entry door 20 from the closed position to the open position.

Entry door 20 can be similarly shifted from the closed position to the open position from the interior of the entry door 20 in the following manner. With the external lock cylinder 100 in the unlocked position, the interior door release control 92 may be actuated, which is preferably by rotation of a rotatable lever, which displaces the interior plunger arm 134 laterally and moves the plunger 102 inwardly, which causes the door latch 52 to shift to the unlatched position. The door latch 52 thereby disengages from the door strike recess 50, and permits the user to shift entry door 20 from the closed position to the open position.

In order to return the entry door 20 to the closed and latched position from either the exterior or interior of the entry door 20, the user simply swings the entry door 20 to the closed position, which causes the door latch 52 (here, a spring bolt 54) to strike the door strike 48 and engage the door strike recess 50. When the entry door 20 is in the fully closed and latched position, the same can be positively locked in place by rotation of the external lock cylinder 100. More specifically, a matching key is inserted into the key slot in the external lock cylinder 100, and the same are then rotated from the unlocked position to the locked position, as further discussed below.

According to a first embodiment of the latch assembly 40 disclosed herein, the door latch 52 includes a spring bolt 54 integrated with the plunger 102. That is, the plunger recess 104 and longitudinal slot 106 are perpendicular with the jamb section 44 and the spring bolt 54 integrated with the plunger 102 slides in a direction perpendicular with the jamb section 44 of the door opening 46.

Preferably, the spring bolt 54 has an outer end 148 that extends exterior of the outside housing 60 for engagement with the associated door strike 48 having a door strike recess 50 and an inner end 150 thereof which extends interior of the outside housing 60 and is integral with the plunger 102. The outer end 148 of the spring bolt 54 preferably has a first inclined surface 152 that faces the door strike recess 50 on the door strike 48 when the entry door 20 is in the open position and a second inclined surface 154 that engages the door strike recess 50 when the entry door 20 is in the closed position, the second inclined surface 154 extending outwardly toward the exterior of the housing.

Thus, in accordance with the first embodiment of the latch assembly 40 disclosed herein, in order to return the entry door 20 to the closed and latched position from either the exterior or interior of the closure, the user simply shifts the entry door 20 to the closed position, which causes the first inclined surface 152 on the spring bolt 54 to strike the door strike 48 and thereby push the spring bolt 54 into the interior of the latch assembly 40. When the spring bolt 54 comes into registry with the door strike recess 50, the spring bolt 54 is urged back to the latched position by virtue of the spring biasing force exerted by the resilient member 112, thereby preventing the entry door 20 from being inadvertently shifted from the closed position to the open position.

The second inclined surface 154 at the outer end 148 of the spring bolt 54 also may have a slightly inclined surface relative its longitudinal length that replaces the normally flat surface opposite the first inclined surface 152. It has been found that such a second inclined surface 154, which extends outwardly toward the marginal edge of the latch assembly 40 at about 4° relative the longitudinal length of the spring bolt, provides a greater resistance to inadvertent opening of the entry door 20 and more reliable engagement with the door strike recess 50, particularly when the latch assembly 40 is applied to a recreational vehicle 8 or other mobile application subject to significant vibrations during transit.

In addition, according to the first embodiment of the latch assembly 40, the handle cam 124 has a distal end 156 proximate the cam surface 126 and the first end 84 of the external lever handle 82 is operably coupled to the handle cam 124 by a threaded fastener 158 extending through an orifice 160 in the handle cam 124 and threadingly received within a threaded opening 162 in the first end 84 of the external lever handle 82. Preferably, the orifice 160 in the handle cam 124 is provided with a shoulder 164 upon which a head 166 of the threaded fastener 158 is disposed.

As a further feature of the first embodiment of the latch assembly disclosed herein, a lock bolt rack 168 may be operably coupled with a cam gear 170 and slidably retained within a rack slot 172 transverse to the plunger recess 104 within which plunger 102 is slidably received. A deadbolt clutch 174 may be operably and rotatably coupled with the external lock cylinder 100, while the cam gear 170 may be operably and rotatably coupled with the deadbolt clutch 174.

Figure 5:
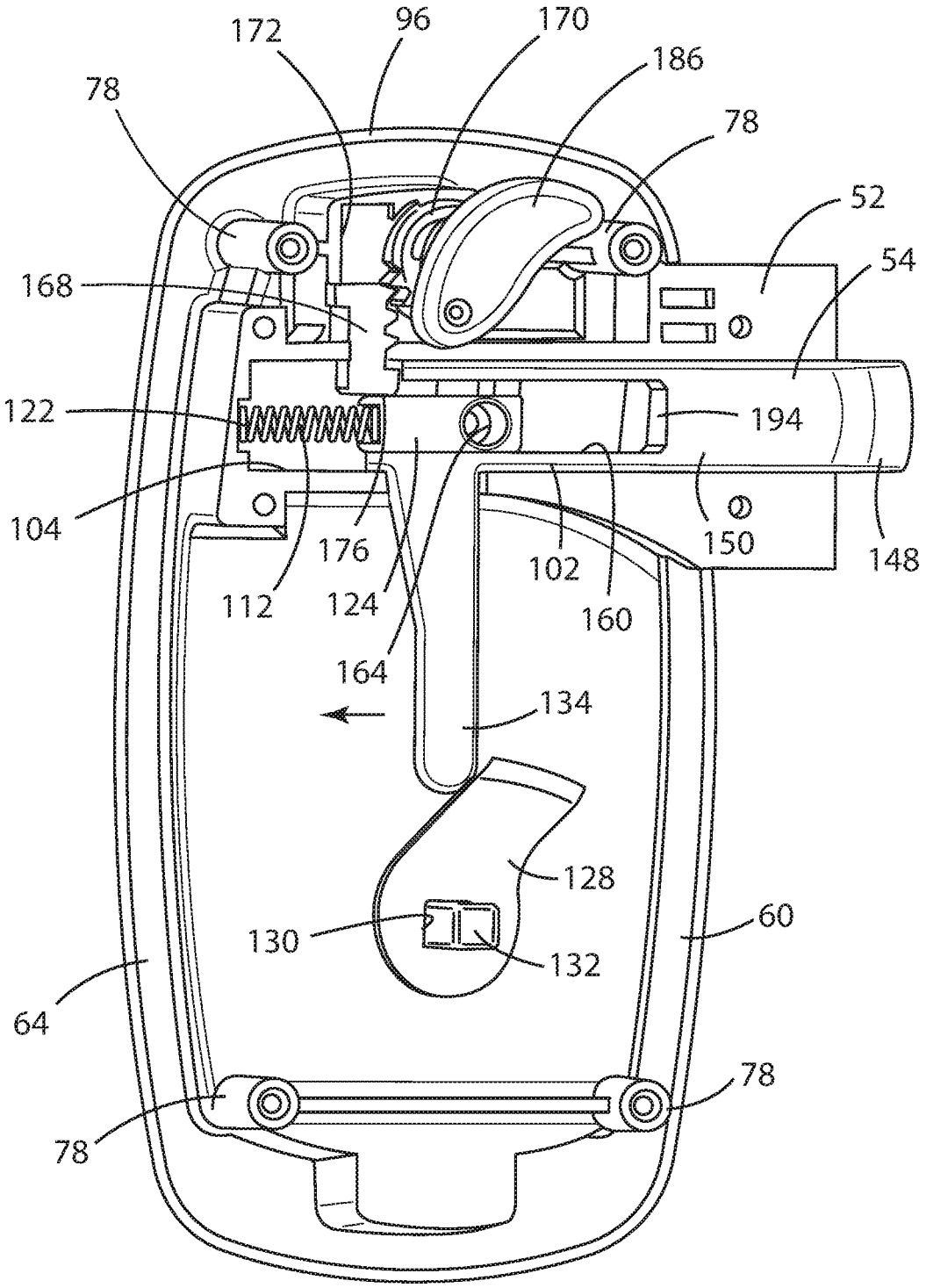
FIG. 5 is a perspective interior view of the of the inner face of the outside housing of the first embodiment of the latch assembly of the present disclosure shown in FIG. 2.
Figure 6:
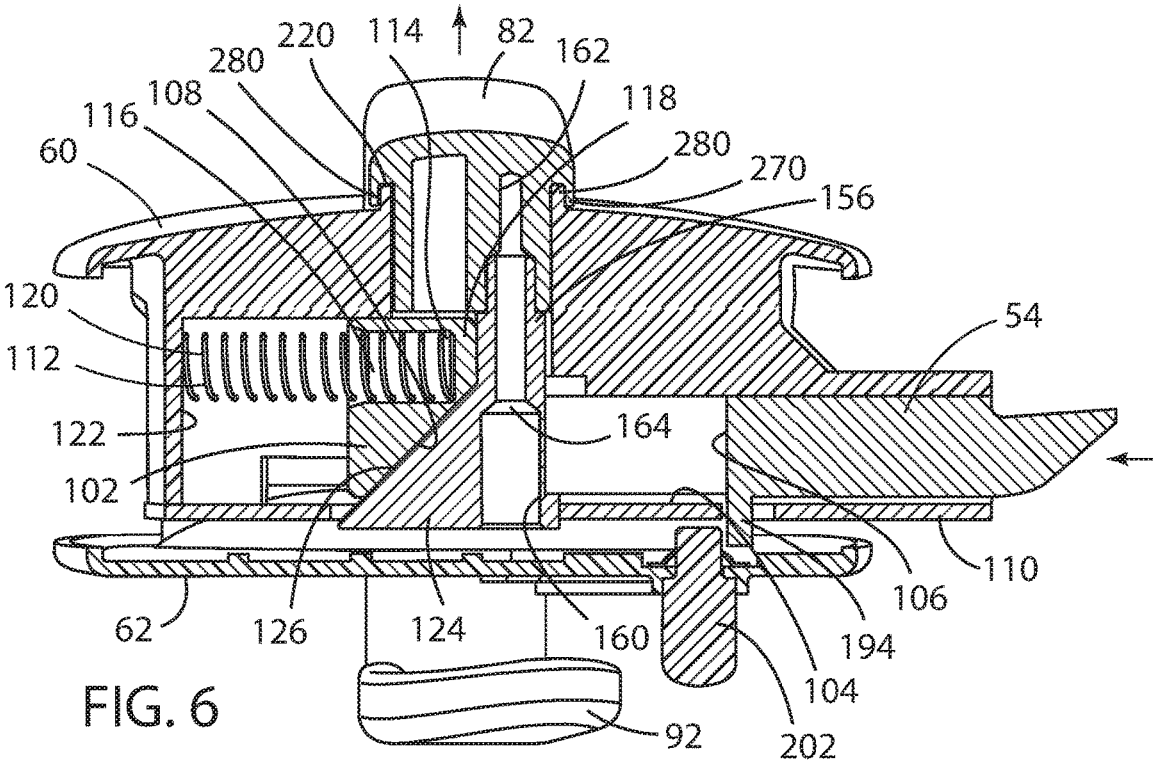
FIG. 6 is a cross-sectional view of the first embodiment of the latch assembly of the present disclosure shown in FIG. 2, with the door latch in the latched position, taken along the line 6-6 in FIG. 2.
Figure 7:
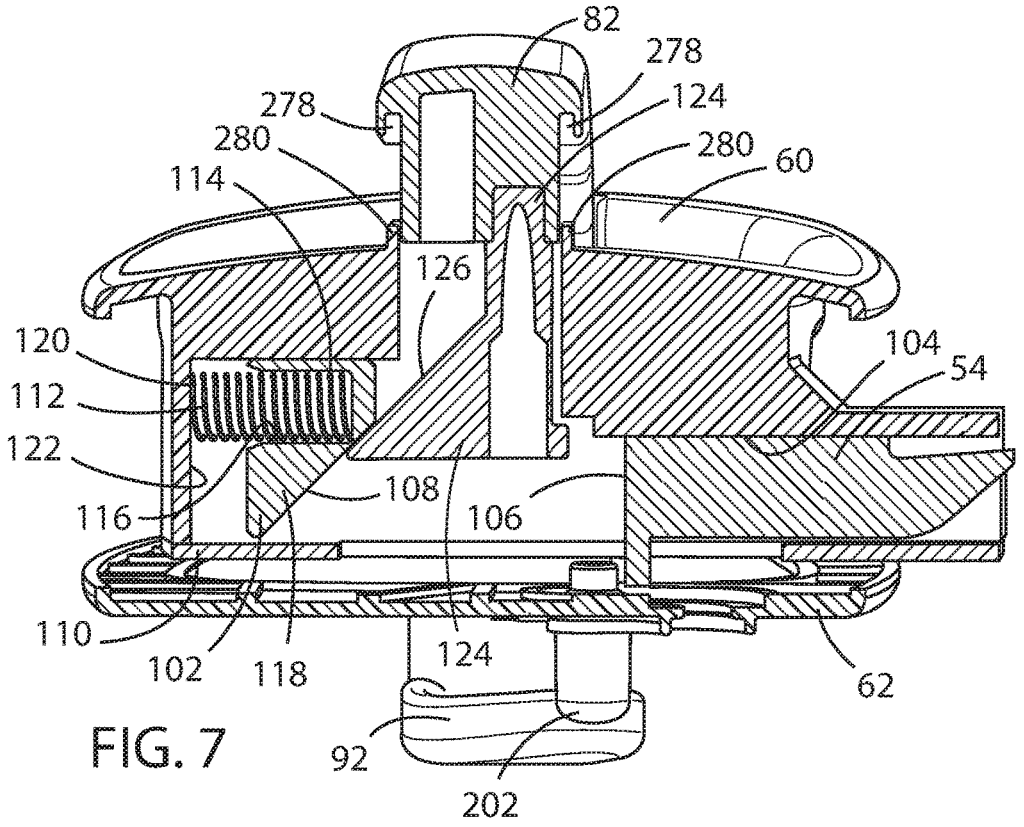
FIG. 7 is a cross-sectional view of the first embodiment of the latch assembly of the present disclosure shown in FIG. 2, with the door latch in the unlatched position, taken along the line 6-6 in FIG. 2.
Figure 8:
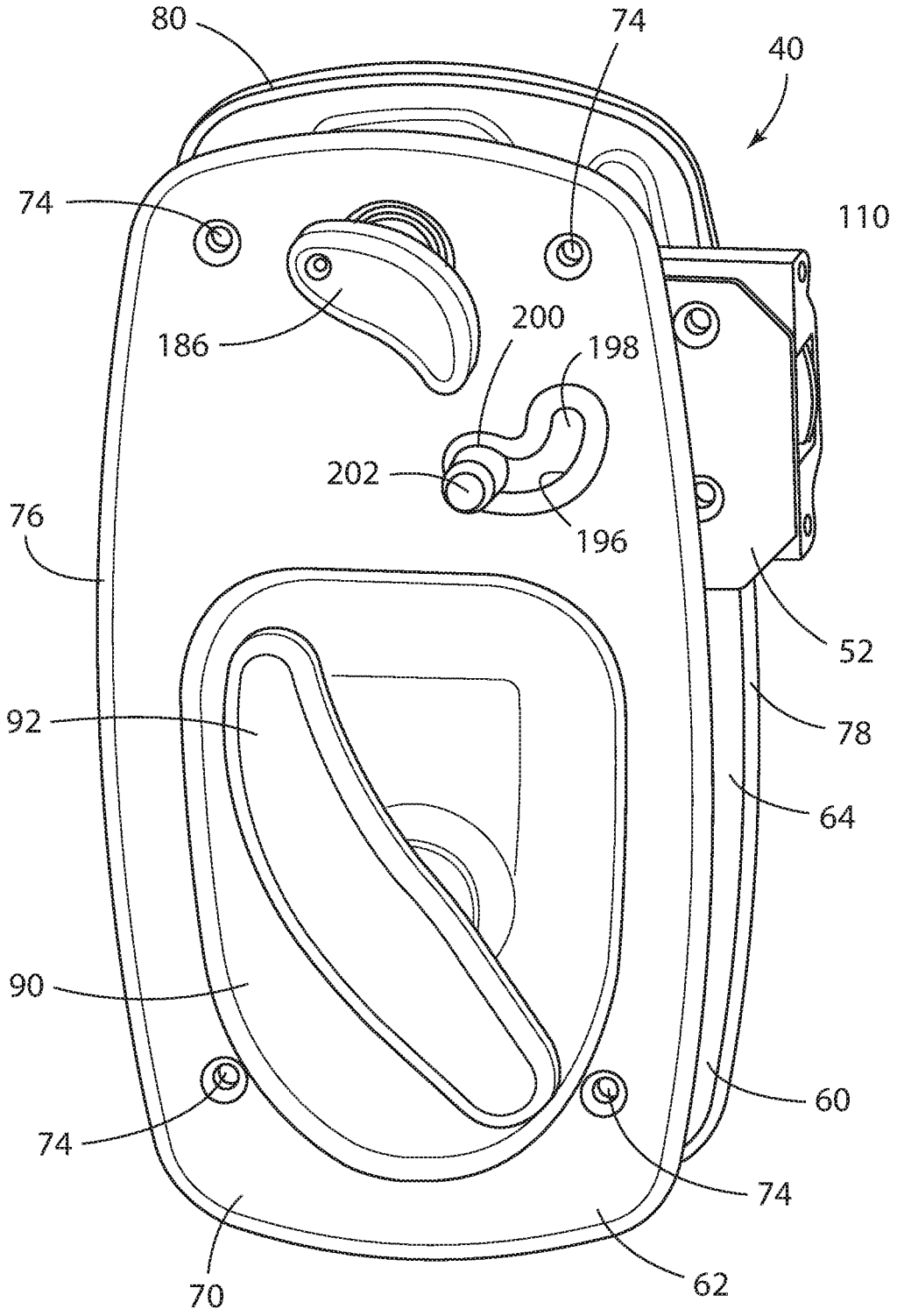
FIG. 8 is perspective interior view of a first embodiment of the latch assembly of the present disclosure, shown with the door latch in the unlatched position.
Figure 9:
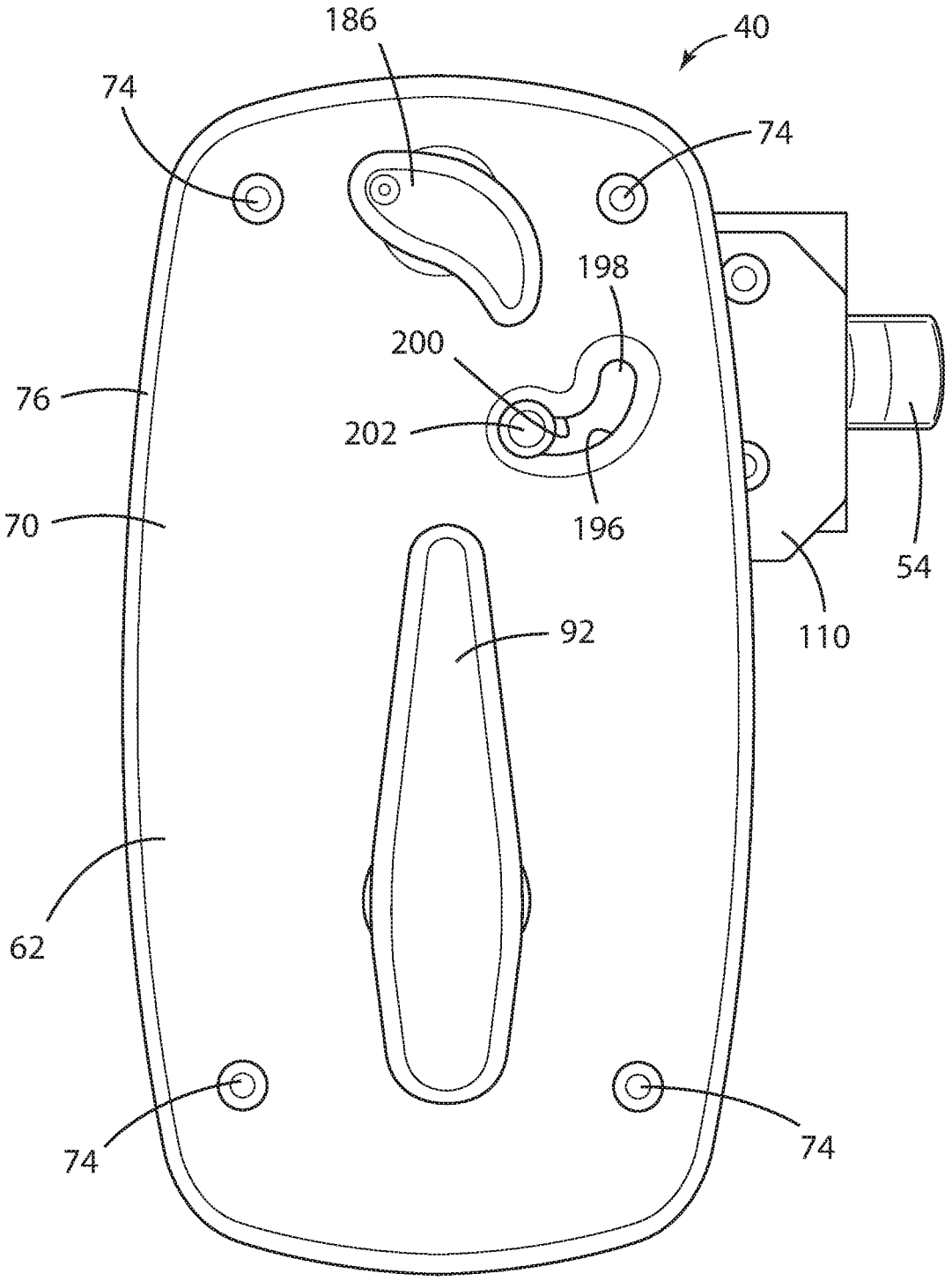
FIG. 9 is an interior elevation view of a first embodiment of the latch assembly of the present disclosure, shown with the door latch in the latched position.
Figure 10:
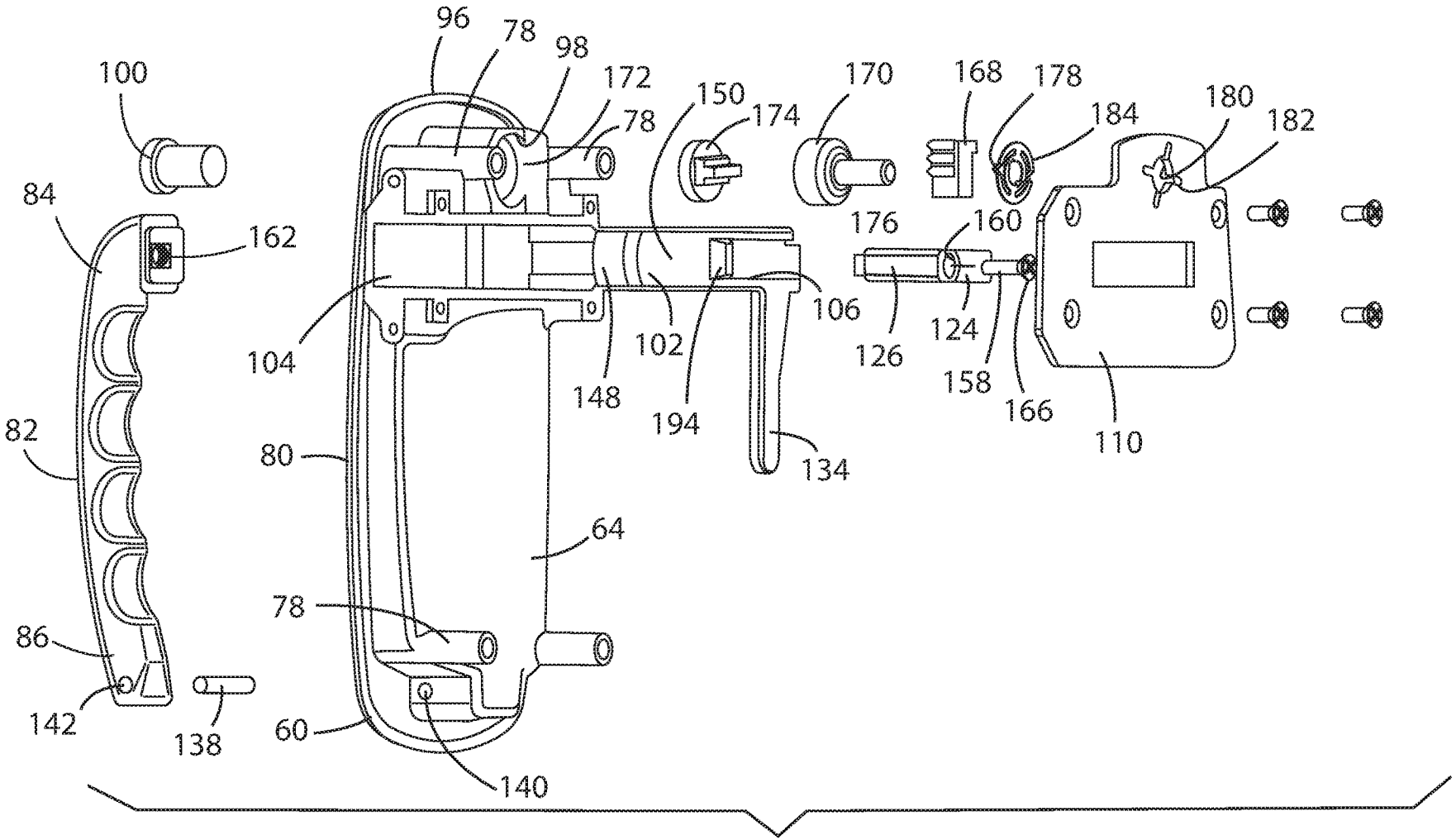
FIG. 10 is an exploded perspective interior view of a first embodiment of the latch assembly of the present disclosure shown in FIG. 2.
Figure 11:
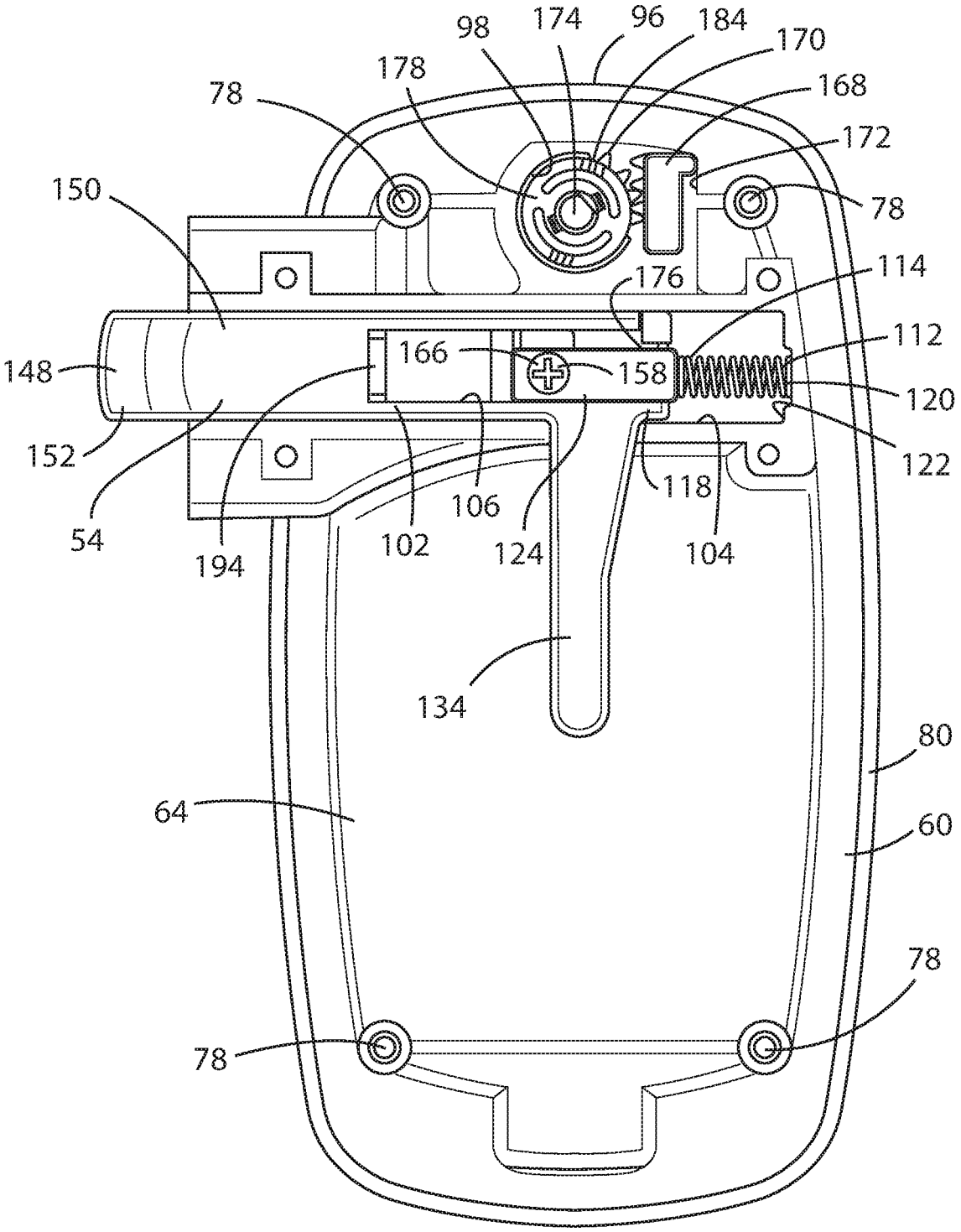
FIG. 11 is an interior elevation view of the of the inner face of the outside housing of the first embodiment of the latch assembly of the present disclosure shown in FIG. 2, with the lock bolt rack in the unlocked position.
Figure 12:
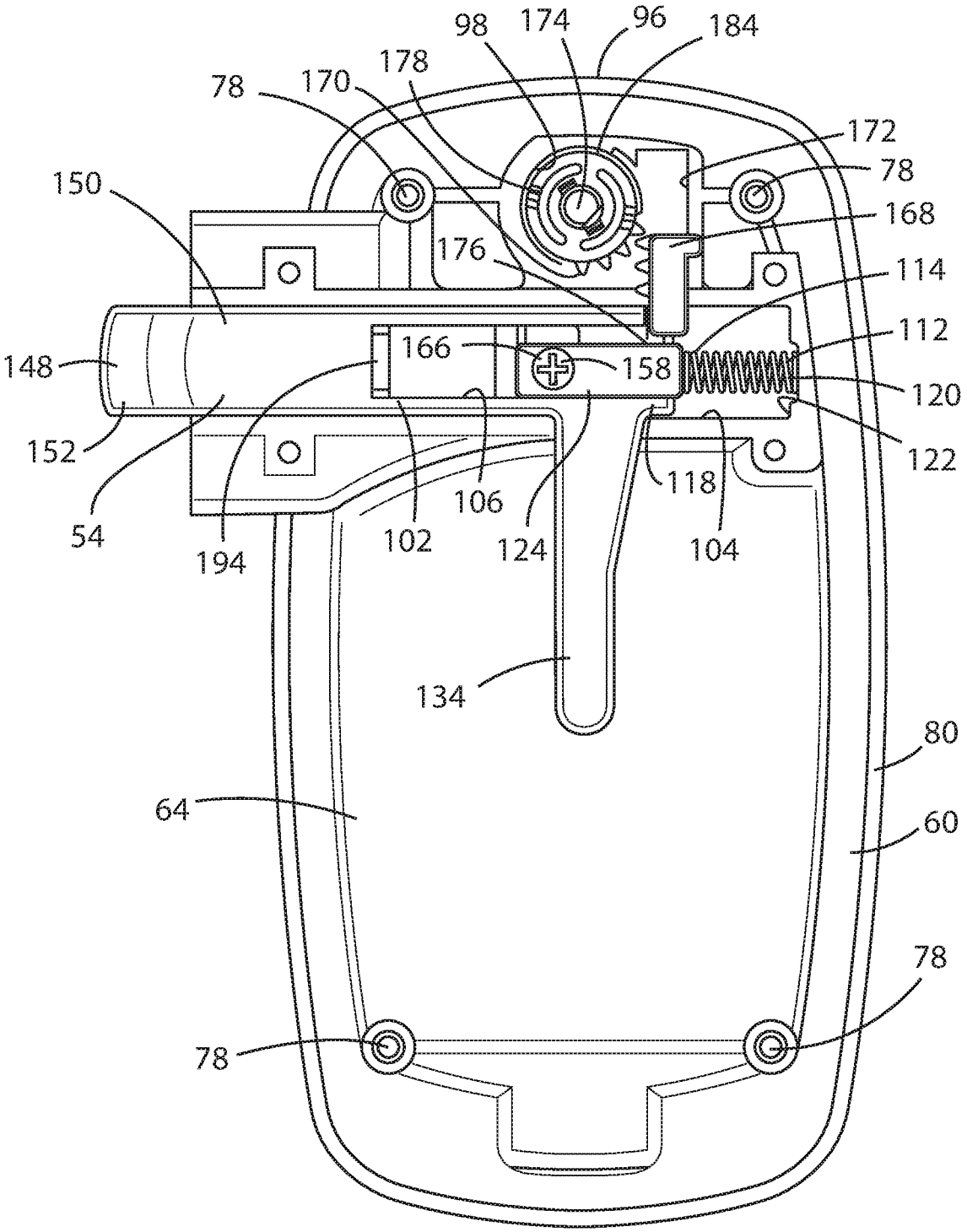
FIG. 12 is an interior elevation view of the of the inner face of the outside housing of the first embodiment of the latch assembly of the present disclosure shown in FIG. 2, with the lock bolt rack in the locked position.
Figure 13:
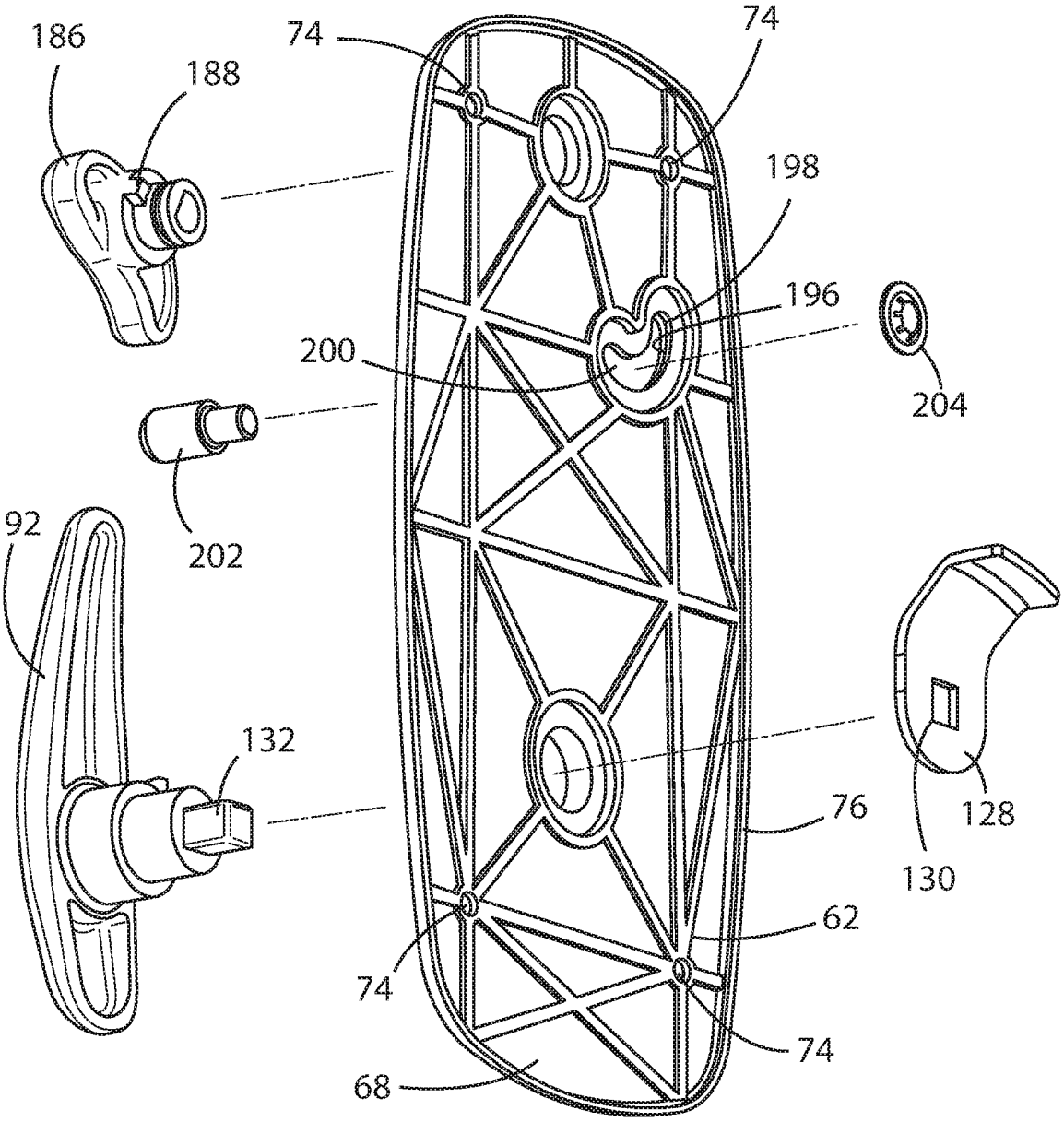
FIG. 13 is an exploded perspective view of the inside plate assembly of the first embodiment of the latch assembly of the present disclosure shown in FIG. 2.
Figure 14:
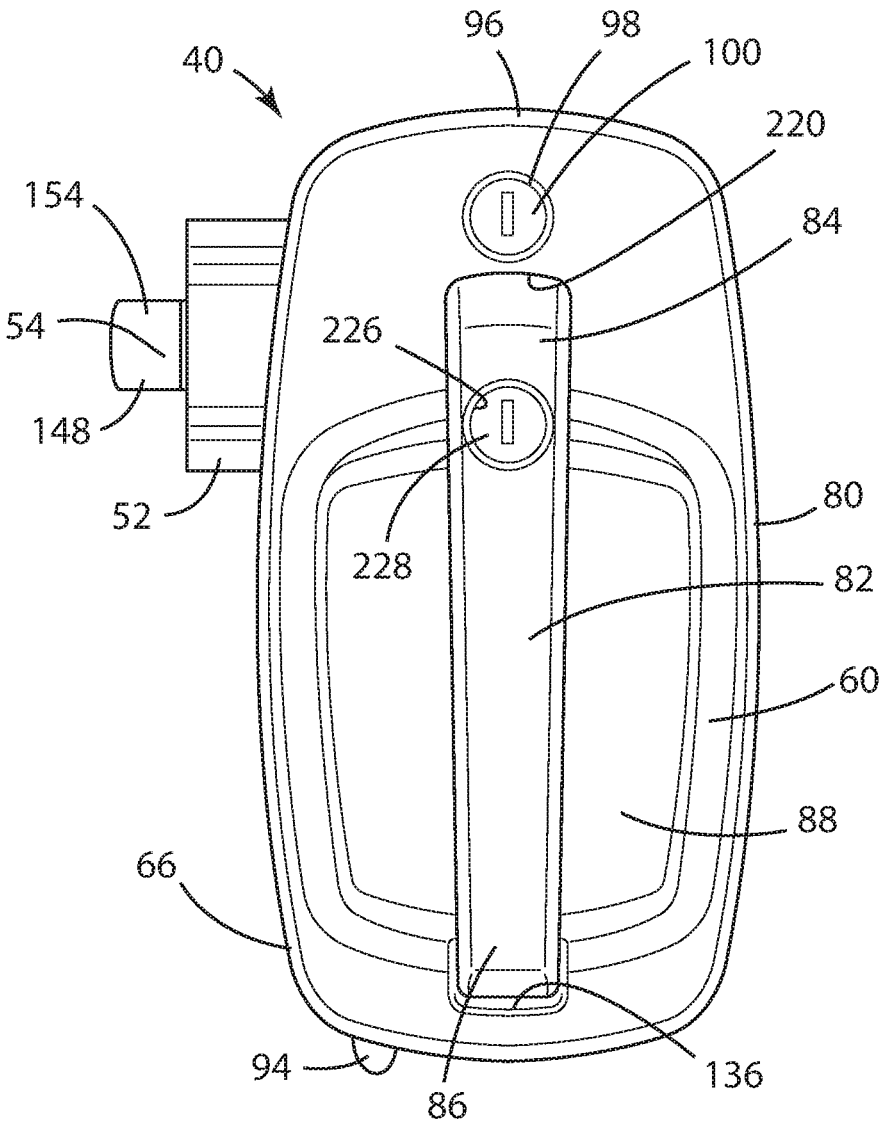
FIG. 14 is an exterior elevation view of a second embodiment of the latch assembly of the present disclosure, shown with the door latch in the latched position.
Figure 15:
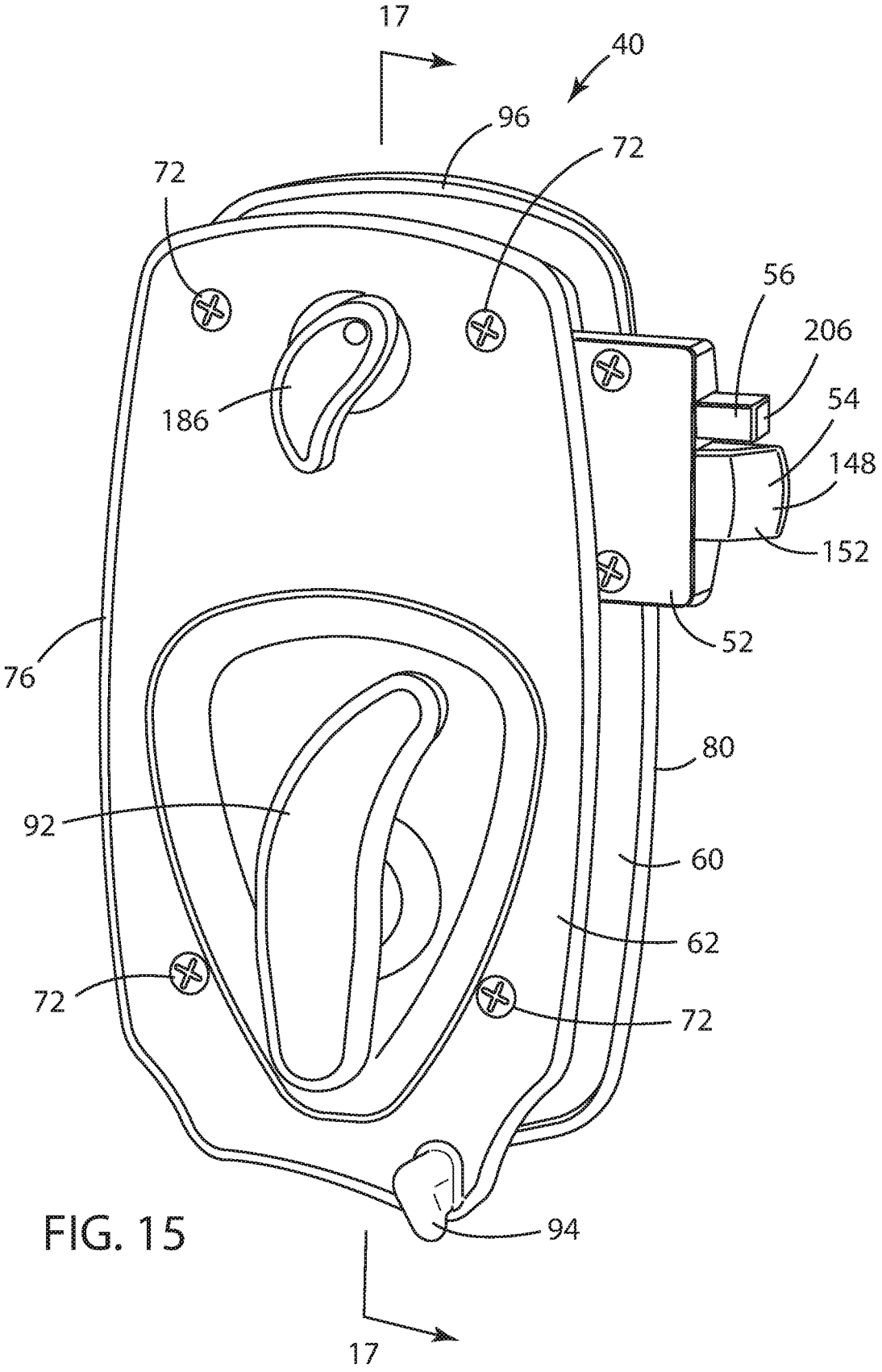
FIG. 15 is perspective interior view of the second embodiment of the latch assembly of the present disclosure, shown with the door latch and deadbolt in the latched position.
Figure 16:
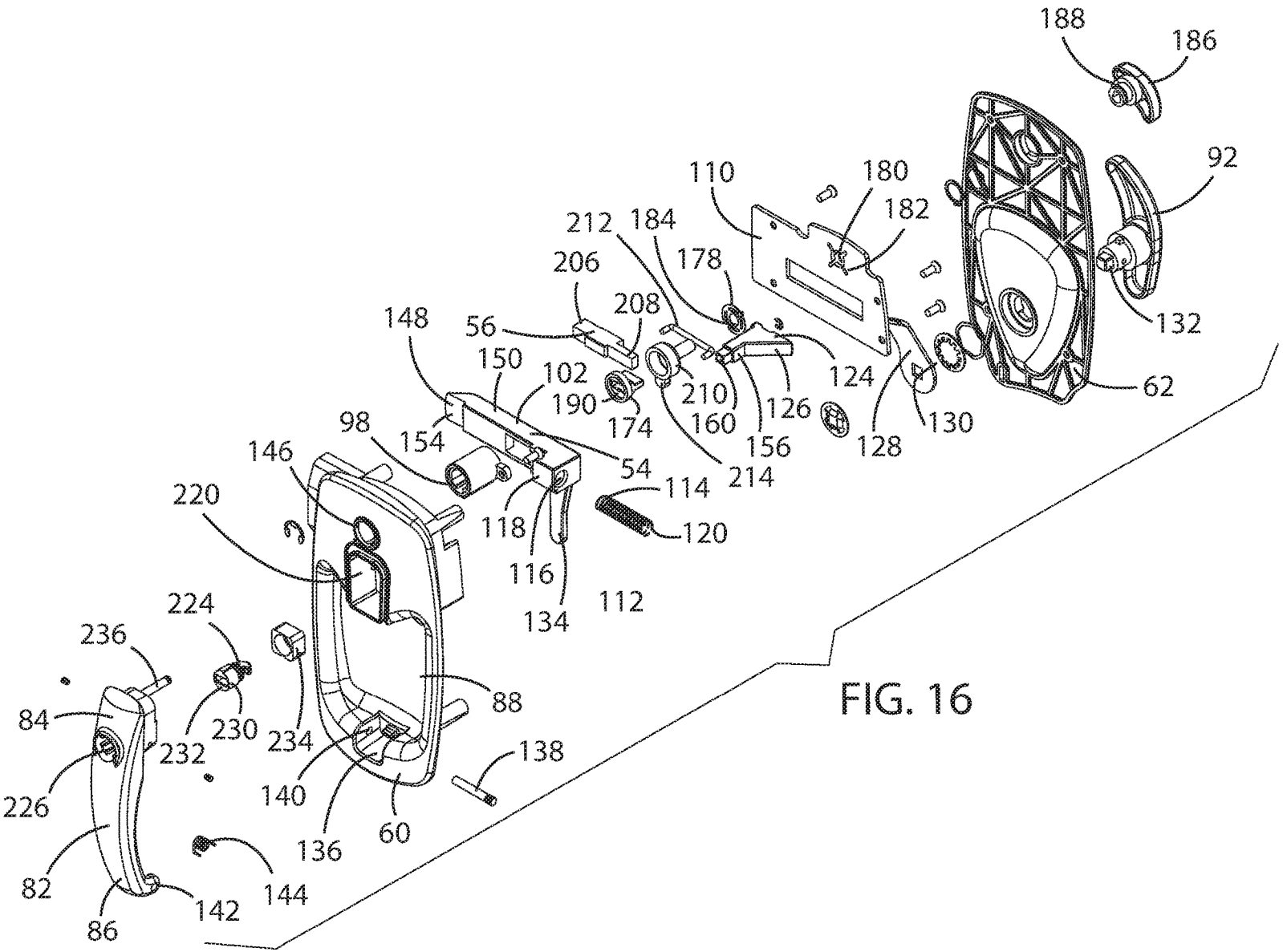
FIG. 16 is an exploded perspective interior view of the second embodiment of the latch assembly of the present disclosure shown in FIG. 15.
Figure 17:
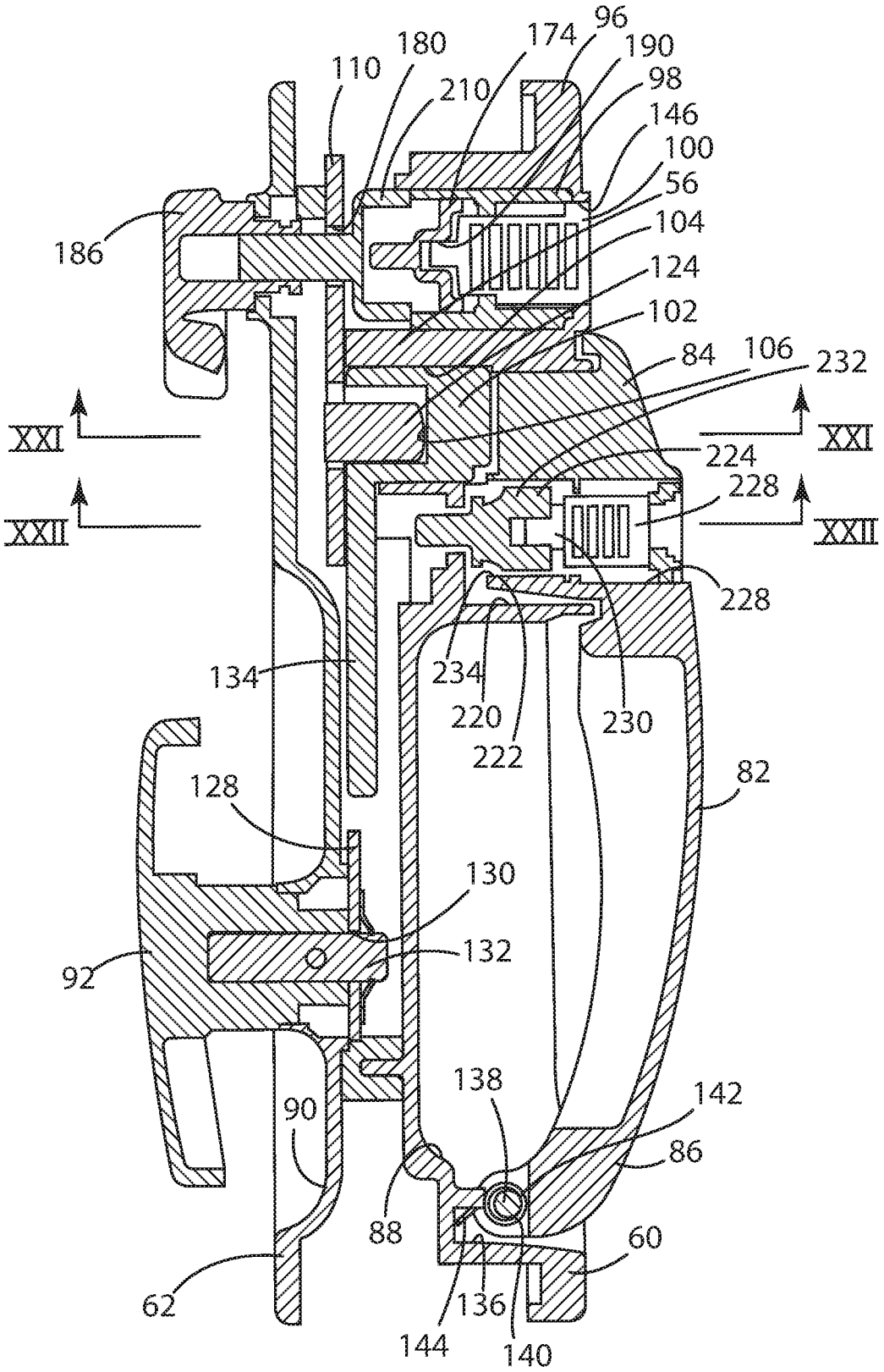
FIG. 17 is a cross-sectional view of the second embodiment of the latch assembly of the present disclosure shown in FIG. 15, taken along the line 17-17 in FIG. 15.
Figure 18:
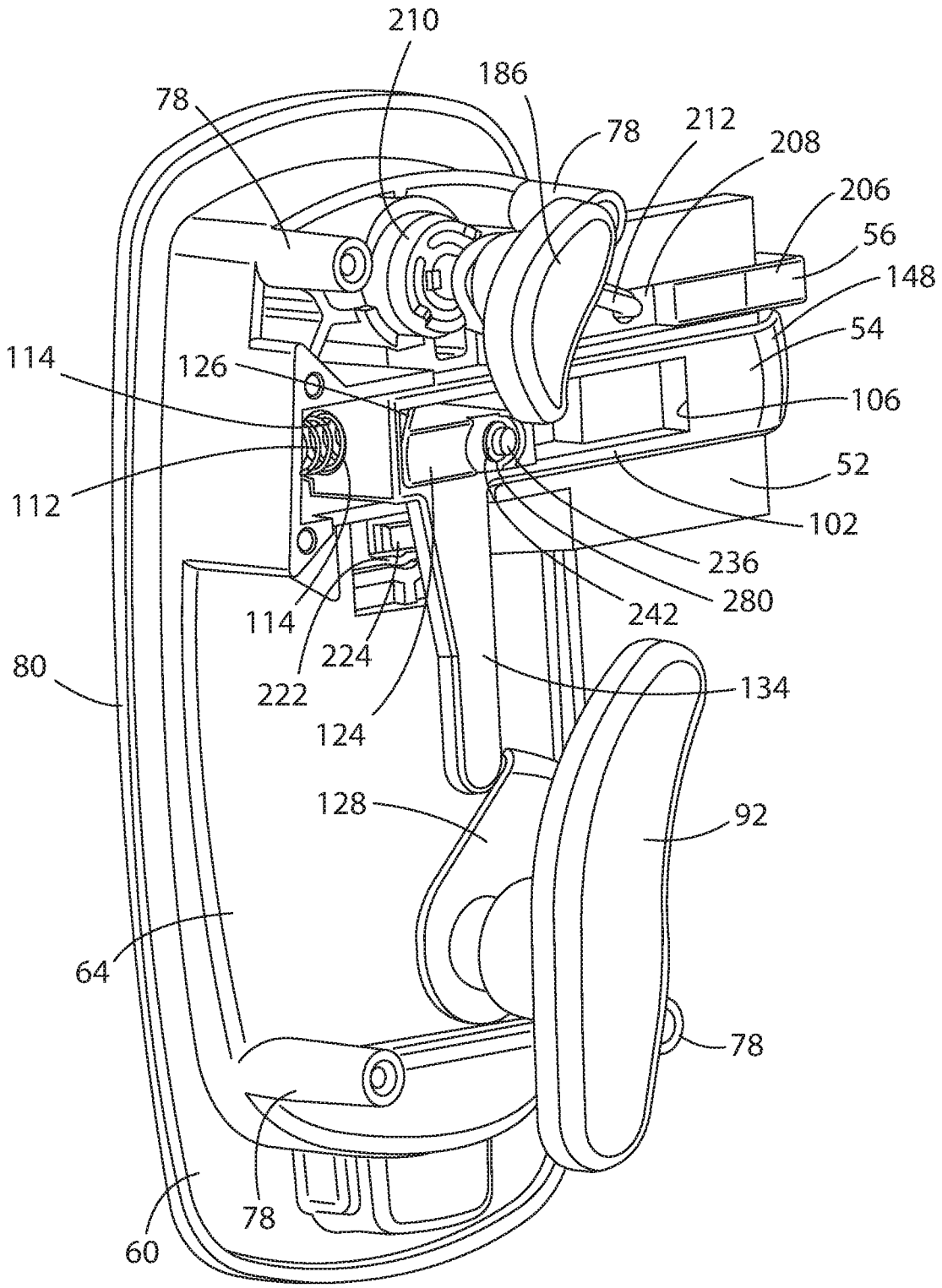
FIG. 18 is a perspective view of the inner face of the outside housing of the second embodiment of the latch assembly of the present disclosure shown in FIG. 15, with the spring bolt and deadbolt in the latched position.
Figure 19:
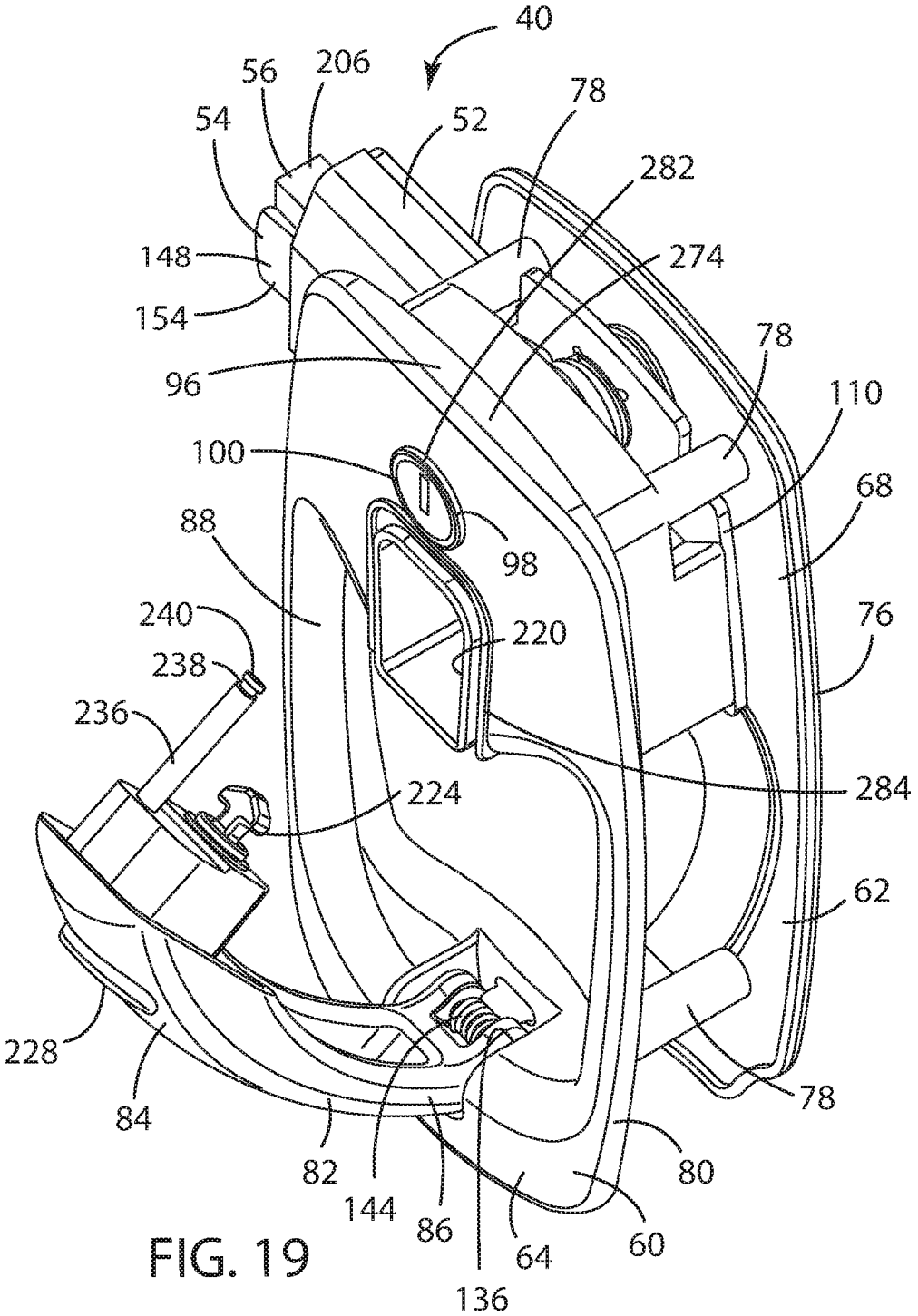
FIG. 19 is a perspective exterior view of the of the second embodiment of the latch assembly of the present disclosure shown in FIG. 15, with the external lever handle disengaged from the latch assembly at a first end thereof.
Figure 20:
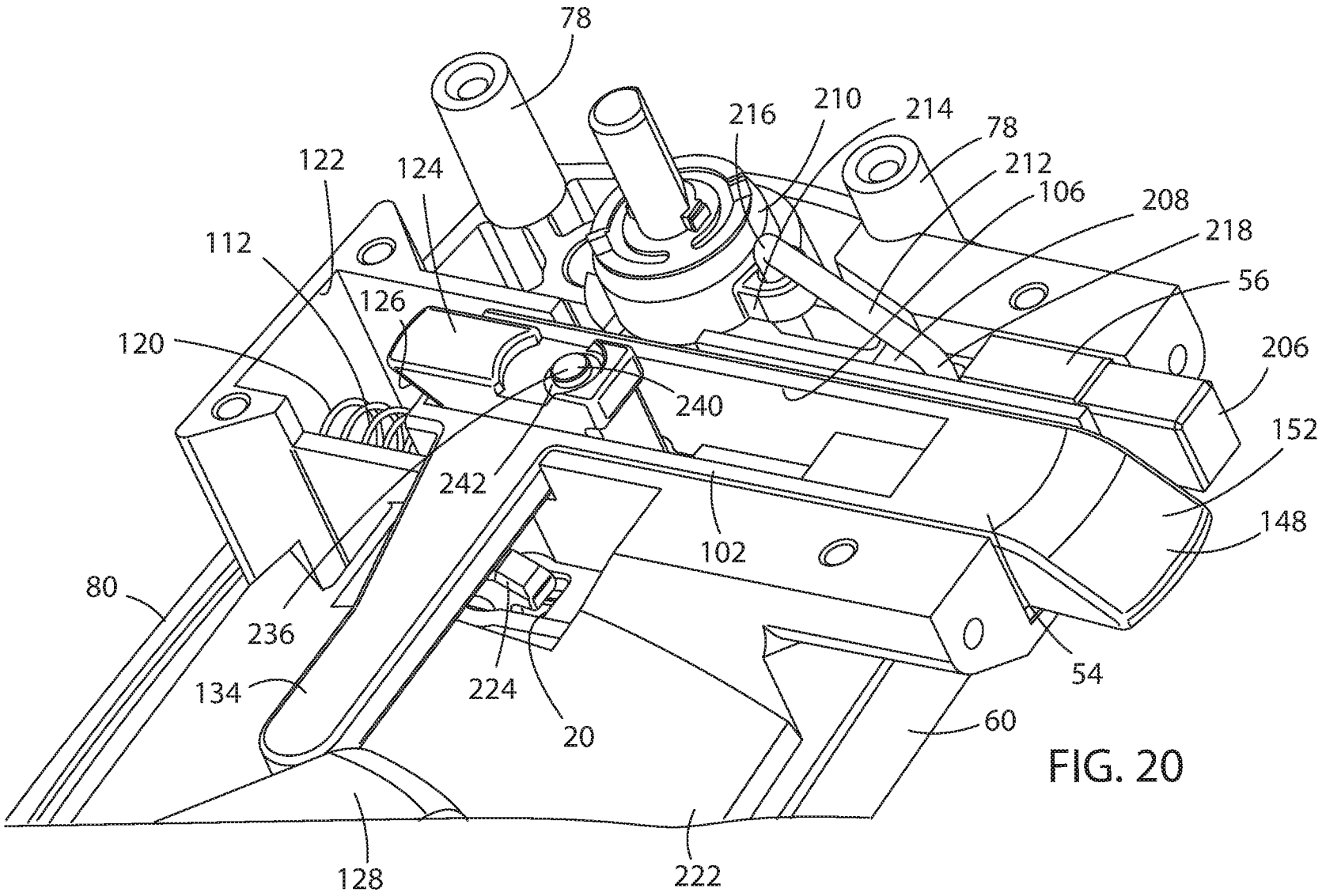
FIG. 20 is a perspective view of a portion of the inner face of the outside housing of the second embodiment of the latch assembly of the present disclosure shown in FIG. 15, with the spring bolt and deadbolt in the latched position.
Figure 21:
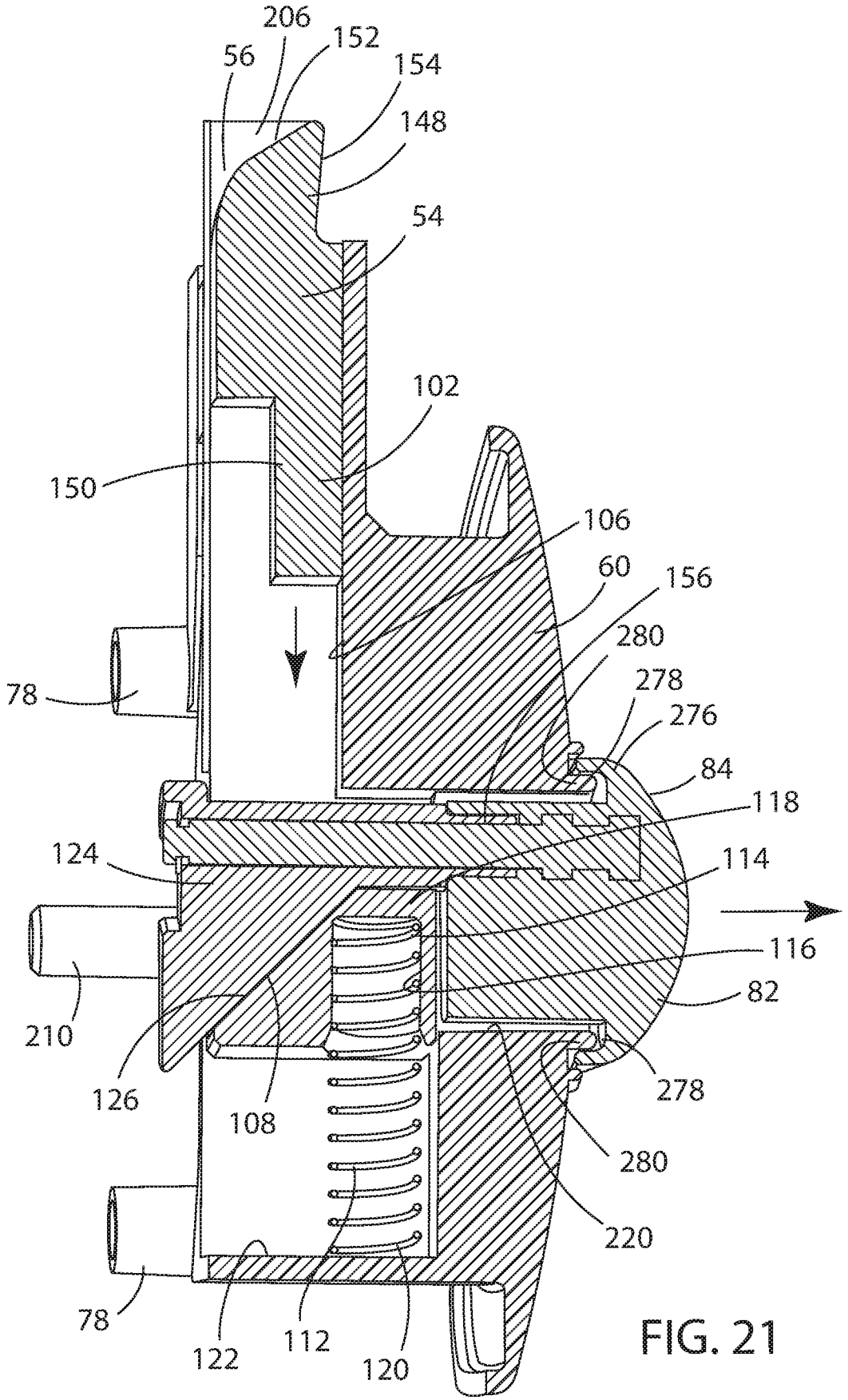
FIG. 21 is a cross-sectional view of the second embodiment of the latch assembly of the present disclosure shown in FIG. 15, taken along the line 21-21 in FIG. 17.
Figure 22:
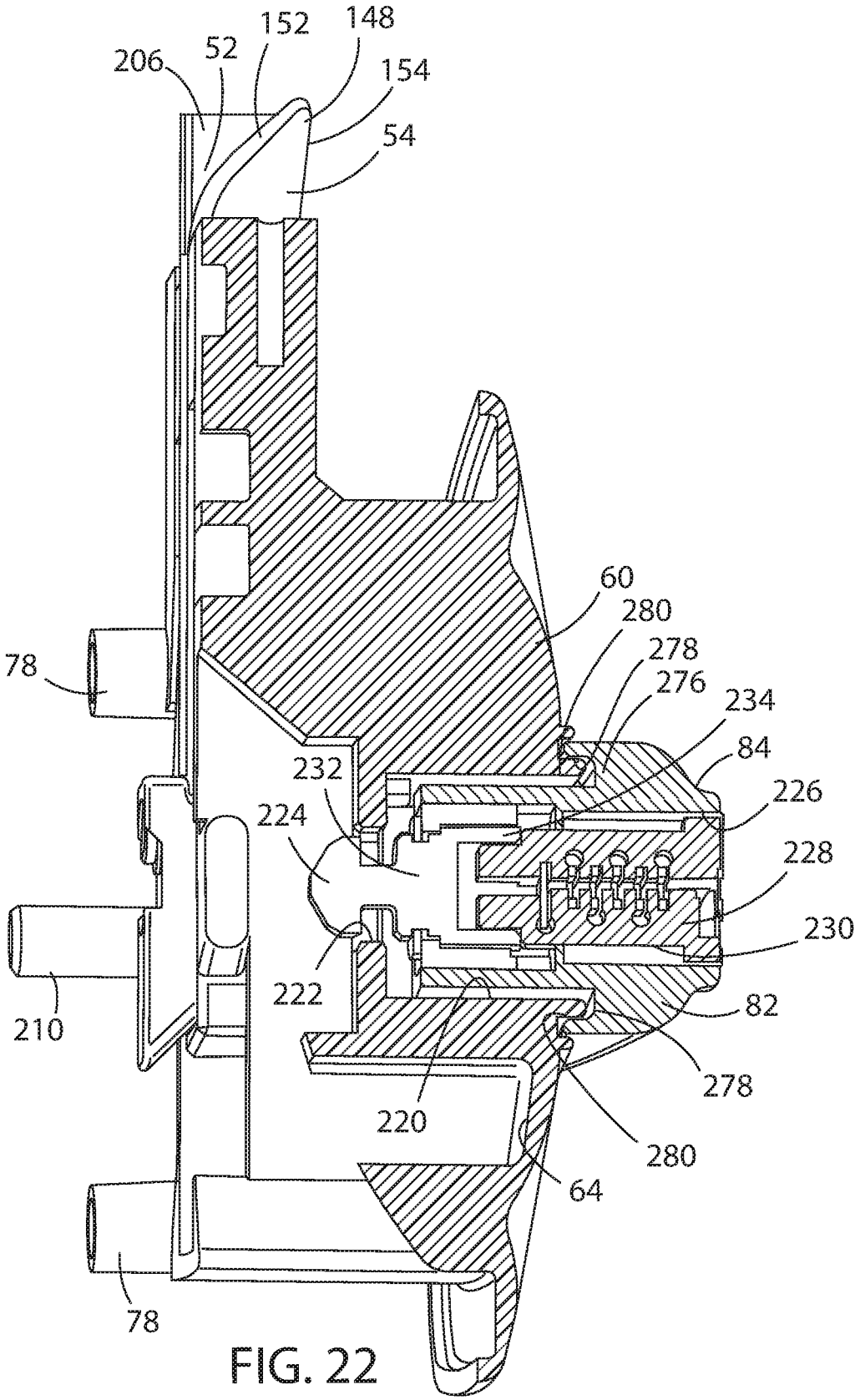
FIG. 22 is a cross-sectional view of the second embodiment of the latch assembly of the present disclosure shown in FIG. 15, taken along the line 22-22 in FIG. 17.
Figure 23:
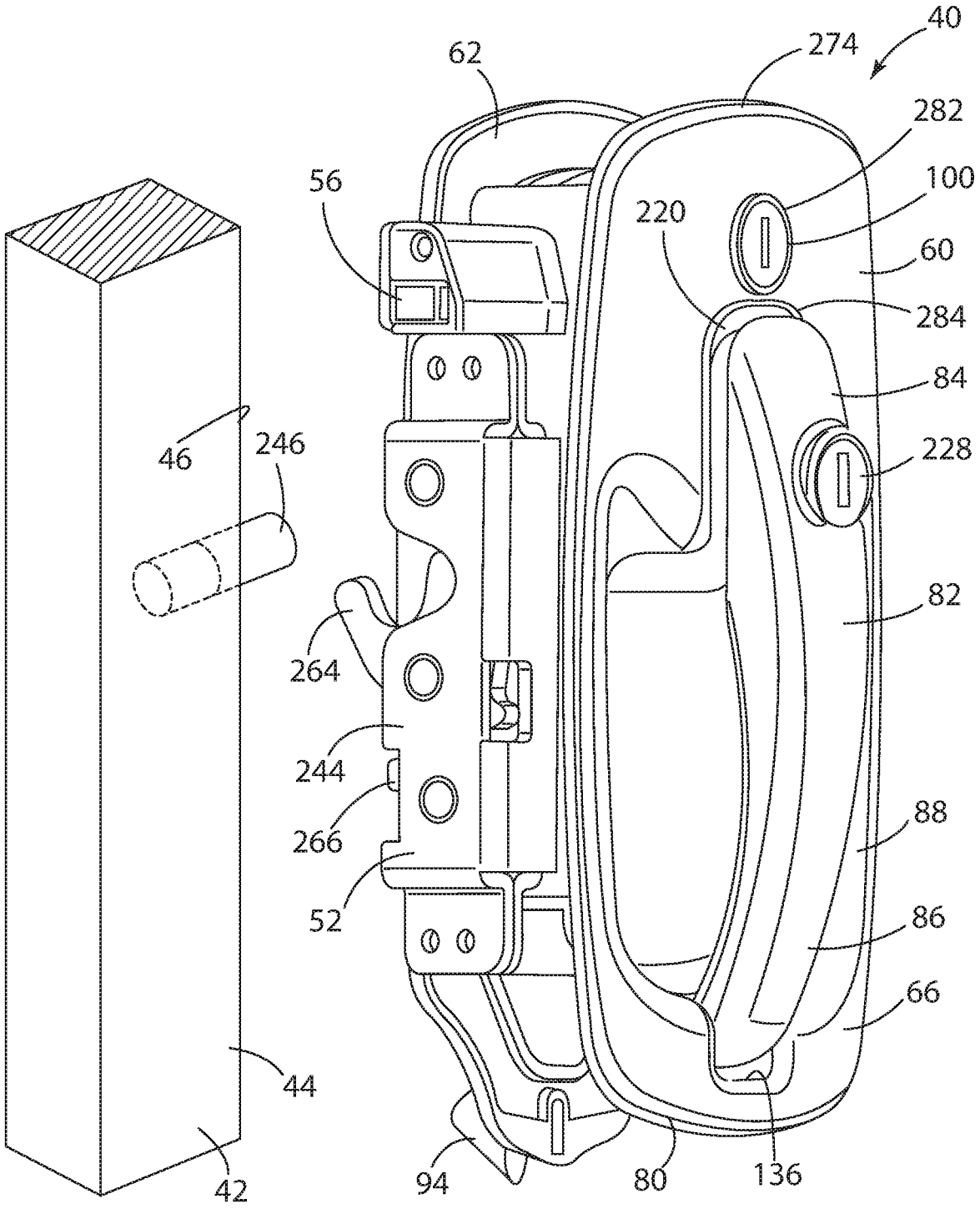
FIG. 23 is a perspective exterior view of a third embodiment of the latch assembly of the present disclosure, shown with the door latch and deadbolt in the unlatched position.
Figure 24:
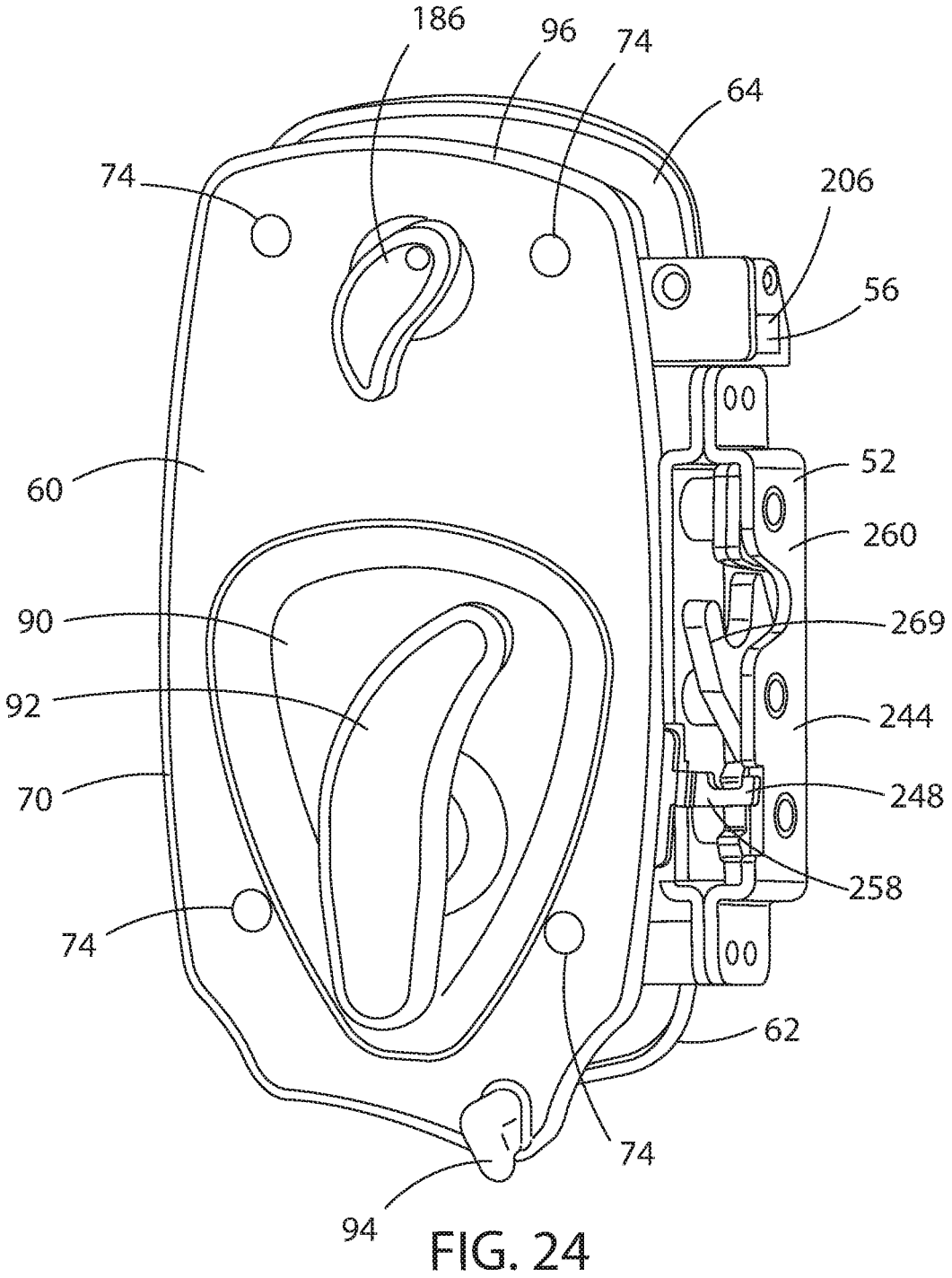
FIG. 24 is a perspective interior view of the third embodiment of the latch assembly of the present disclosure, shown with the door latch and deadbolt in the unlatched position.
Figure 25:
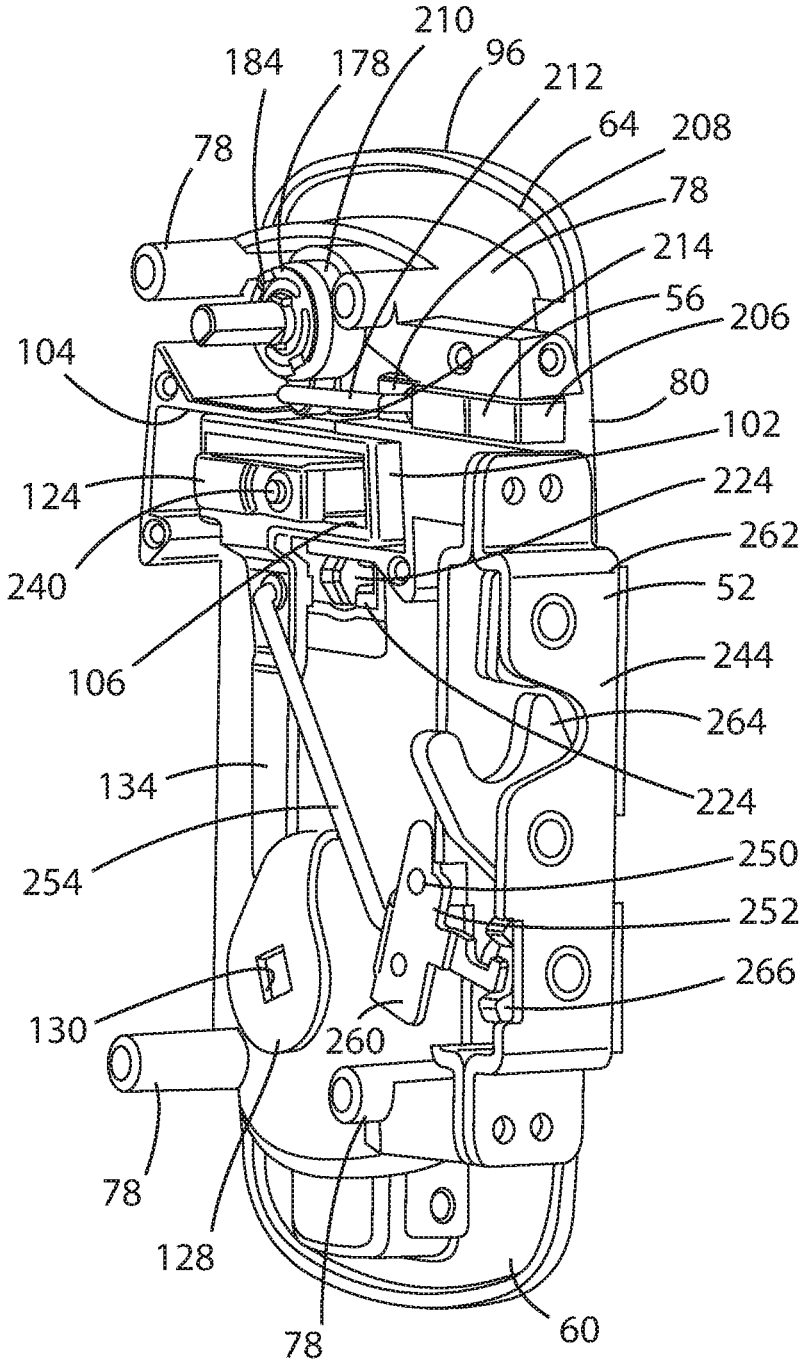
FIG. 25 is a perspective interior view of the of the inner face of the outside housing of the third embodiment of the latch assembly of the present disclosure, shown with the door latch and deadbolt in the unlatched position.

Rotation of the external lock cylinder 100 from the unlocked condition to the locked condition also rotates the cam gear 170. Since the cam gear 170 is in engagement with the lock bolt rack 168, rotary motion is converted to linear motion, and the lock bolt rack 168 is shifted to a locked position within the rack slot 172. When in the locked position within the rack slot 172, the lock bolt rack 168 engages a notch 176 in the plunger 102 to prevent shifting of the plunger 102 from the latched position to the unlatched position, as shown in FIGS. 5 and 12. Conversely, rotation of the external lock cylinder 100 from the locked condition to the unlocked condition rotates the cam gear 170 in the opposite direction and slides the lock bolt rack 168 to an unlocked position, whereby the lock bolt rack 168 is disengaged from the notch 176 in the plunger 102 to allow shifting of the plunger 102 from the latched position to the unlatched position, as shown in FIG. 11.

Preferably, a deadbolt clutch spring 178 may be disposed between the inside plate 110 mounted to the inner face 64 of the outside housing 60 and the cam gear 170. The inside plate 110 preferably is provided with an opening 180 through which the cam gear 170 extends and a plurality of symmetrically arranged radial slots 182 that engage opposed radial detents 184 disposed on the deadbolt clutch spring 178, in order to maintain the selected position of the lock bolt rack 168, as described above.

In addition, deadbolt knob 186 may be mounted proximate to the outer face 70 of the inside plate 62. The deadbolt knob 186 has a locked position and an unlocked position and may be operably and rotatably coupled with the external lock cylinder 100, wherein operation of deadbolt knob 186 from the unlocked position to the locked position slides the lock bolt rack 168 to the locked position within the rack slot 172, whereby the lock bolt rack 168 engages the notch 176 in the plunger 102 to prevent shifting of the plunger 102 from the latched position to the unlatched position. Conversely, rotation of the deadbolt knob 186 from the locked condition to the unlocked condition slides the lock bolt rack 168 to an unlocked position, whereby the lock bolt rack 168 is disengaged from the notch 176 in the plunger 102 to allow shifting of the plunger 102 from the latched position to the unlatched position. The deadbolt knob 186 preferably further includes a stop 188 that is received within a recess 190 of a deadbolt clutch 174 to allow independent rotation of the deadbolt knob 186 relative the external lock cylinder 100.

As a further feature of the first embodiment of the latch assembly disclosed herein, the plunger 102 may be provided with an inwardly extending tab 194 disposed on the plunger 102 proximate the inner face 68 of the inside plate 62. An arcuate slot 196 preferably extends through the inside plate 62, where the arcuate slot 196 has a first end 198 aligned with the plunger recess 104 and plunger 102 and a second end 200 that is not aligned with the plunger recess 104 and plunger 102. A night lock knob 202 preferably extends through and is shiftingly restrained in the arcuate slot 196. The night lock knob 202 has a locked position and an unlocked position, whereby shifting the night lock knob 202 to the locked position engages the night lock knob 202 with the inwardly extending tab 194 disposed on the plunger 102, thus preventing the plunger 102 from shifting from the latched position to the unlatched position. Conversely, shifting the night lock knob 202 to the unlocked position disengages the night lock knob 202 from the inwardly extending tab 194 disposed on the plunger 102 to allow shifting of the plunger 102 from the latched position to the unlatched position. Preferably, the night lock knob 202 is slidably restrained in the arcuate slot by lock washer 204.

Thus, the first embodiment of the latch assembly 40 disclosed herein may be locked by either an external lock cylinder 100, an inside deadbolt knob 186, or a night lock knob 202. The external lock cylinder 100 and deadbolt knob 186 each separately controls a cam gear 170 that extends or retracts a lock bolt rack 168. This lock bolt rack 168, in turn, engages the plunger 102 in the latched position and prevents the plunger 102 and door latch 52 (here, spring bolt 54) from moving. The night lock knob 202 may be advantageous for users concerned about the external lock cylinder 100 being picked and can be shifted into a locked position to prevent motion of the plunger 102 independent of the external lock cylinder 100 or inside deadbolt knob 186. By engaging the tab 194 on the plunger 102 to prevent motion, the night lock knob 202 prevents the entry door 20 from being opened externally.

According to a second embodiment of the latch assembly 40 disclosed herein, shown in FIGS. 14-22, a deadbolt 56 separate from the plunger 102 and door latch 52 (here, spring bolt 54) is provided. Additionally, the external lock cylinder 100 is preferably disposed proximate the first end 84 of the external lever handle 82 in order to operate the deadbolt 56, and may be master keyed for dealership use. The night lock knob 202 is omitted in favor of the separate deadbolt 56.

According to the second embodiment of the latch assembly 40 of the present disclosure, the latch assembly 40 similarly includes the lock aperture 98 through the outside housing 60 through which the external lock cylinder 100 extends from the outer face 66. A deadbolt 56 having an outer end 206 and an inner end 208, a lock cam 210, and a first link 212 are added, whereby rotation of external lock cylinder 100 rotates the lock cam 210 mounted to the inner face 64 of the outside housing 60, preferably above the first end 84 of the external lever handle 82. The deadbolt 56 preferably has a cross-sectional lateral thickness that is narrower than a cross-sectional lateral thickness of the spring bolt 54. In addition, the outer end 206 of the deadbolt 56 is preferably tapered.

Rotation of the lock cam 210, by either the external lock cylinder 100 or the deadbolt knob 186, contemporaneously shifts a crank arm 214 of the lock cam 210, to which is pivotally attached a first end 216 of the first link 212. A second end 218 of the first link 212 is in turn pivotally connected with the inner end 208 of the deadbolt 56, whereby the second end 218 of the first link 212 longitudinally shifts the deadbolt 56 from the unlocked position to the locked position. In the unlocked position, the outer end 206 of the deadbolt 56 is fully withdrawn into the interior of the latch assembly 40, as perhaps best shown in FIG. 20. In the locked position, the outer end 206 of the deadbolt 56 engages door strike recess 50 in the door strike 48, and positively prevents opening of the entry door 20. The deadbolt 56 is unlocked by rotating external lock cylinder 100 or deadbolt knob 186 in the opposite direction. Thus, the deadbolt 56 may be movably shifted between a locked position, wherein the entry door 20 is positively retained in the closed position, and an unlocked position, wherein the entry door 20 is free to be shifted between the open and closed positions.

Also, according to the second embodiment of the latch assembly 40 disclosed herein, the outer face 66 of the outside housing 60 may be provided with an upper recess 220 within which the first end 84 of the external lever handle 82 is received. This upper recess 220 may similarly be continuous with the bowl-shaped external lever handle recess 88. The upper recess 220 further preferably includes an elongated slot 222, while the first end 84 of the external lever handle 82 preferably includes a lever lock bolt 224 having a locked position and an unlocked position, the lever lock bolt 224 being received within the elongated slot 222 when in the unlocked position and being retained within the elongated slot 222 when in the locked position, as shown in FIGS. 17, 19, 20, and 22. The locked position of the lever lock bolt 224 is preferably rotationally 90° relative the unlocked position of the lever lock bolt 224.

The first end 84 of the external lever handle 82 further preferably includes an orifice 226 through the first end 84 of the external lever handle 82 through which a handle lock cylinder 228 extends, the handle lock cylinder 28 having a locked condition and an unlocked condition. A clutch 230 is preferably disposed on an exterior end 232 of the lever lock bolt 224 that may be operably and rotatably coupled with the handle lock cylinder 228, through which the handle lock cylinder 228 is operably coupled with the lever lock bolt 224. A clutch holder 234 may be provided by which the lever lock bolt 224 is mounted to the first end 84 of the external lever handle 82. The handle lock cylinder 228 may also be master keyed for dealership convenience.

Further, according to the second embodiment of the latch assembly 40 disclosed herein, the external lever handle 82 is coupled to the handle cam 124 via an alternative structure. That is, the handle cam 124 is still provided with a distal end 156 proximate the cam surface 126. However, the first end 84 of the external lever handle 82 is operably coupled to the handle cam 124 by a handle shaft 236 fixedly mounted in the first end 84 of the external lever handle 82 and extending through and fixed within an orifice 160 in the handle cam 124. The handle shaft 236 further preferably comprises a notch 238 disposed at a distal end 240 thereof and is fixed within the orifice 160 in the handle cam 124 by a C-clamp 242 resiliently received and secured in the notch 238. As further described below, the external lever handle 82 may be injection molded and the handle shaft 236 is preferably fixedly mounted in the first end 84 of the external lever handle 82 during the molding process.

In accordance with a third embodiment of the latch assembly of the present disclosure, a rotary latch assembly 244 is employed as the door latch 52, as shown in FIGS. 22-28. In this embodiment, the rotary latch assembly 244 has a locked position and an unlocked position. A door striker 246 may be disposed on the jamb section 44 of the door opening 46 for engagement with the rotary latch assembly 244.

A rotary latch cam 248 is preferably pivotably mounted at a pivot 250 at a first end 252 to the inner face 64 of the outside housing 60 proximate the rotary latch assembly 244. A second link 254 having a first end 256 thereof may be pivotally operably coupled with the plunger 102 and a second end 258 thereof may be pivotally connected with a second end 260 of the rotary latch cam 248. The first end 256 of the second link 254 is preferably operably coupled with the interior plunger arm 134.

The rotary latch assembly preferably comprises a frame 262 attached to the margin 80 of the outside housing 60, a lock pawl 264 rotatably mounted to the frame 262 and having a locked position in engagement with the door striker 246 and an unlocked position, and a trigger 266 rotatably mounted to the frame 262 and operably coupled with the rotary latch cam 248 and a detent 268 on the lock pawl to 264. The trigger 266 has a locked position and an unlocked position. The rotary latch cam 248 rotates the trigger 266 from the locked position to the unlocked position as the plunger 102 shifts from the latched position to the unlatched position, thus bringing the trigger 266 out of engagement with a detent 268 and releasing the lock pawl 264 to the unlocked position. Thus, shifting the plunger 102 to the unlatched position rotates the rotary latch cam 248 to shift the rotary latch assembly 244 between the locked and unlocked positions.

Figure 26:
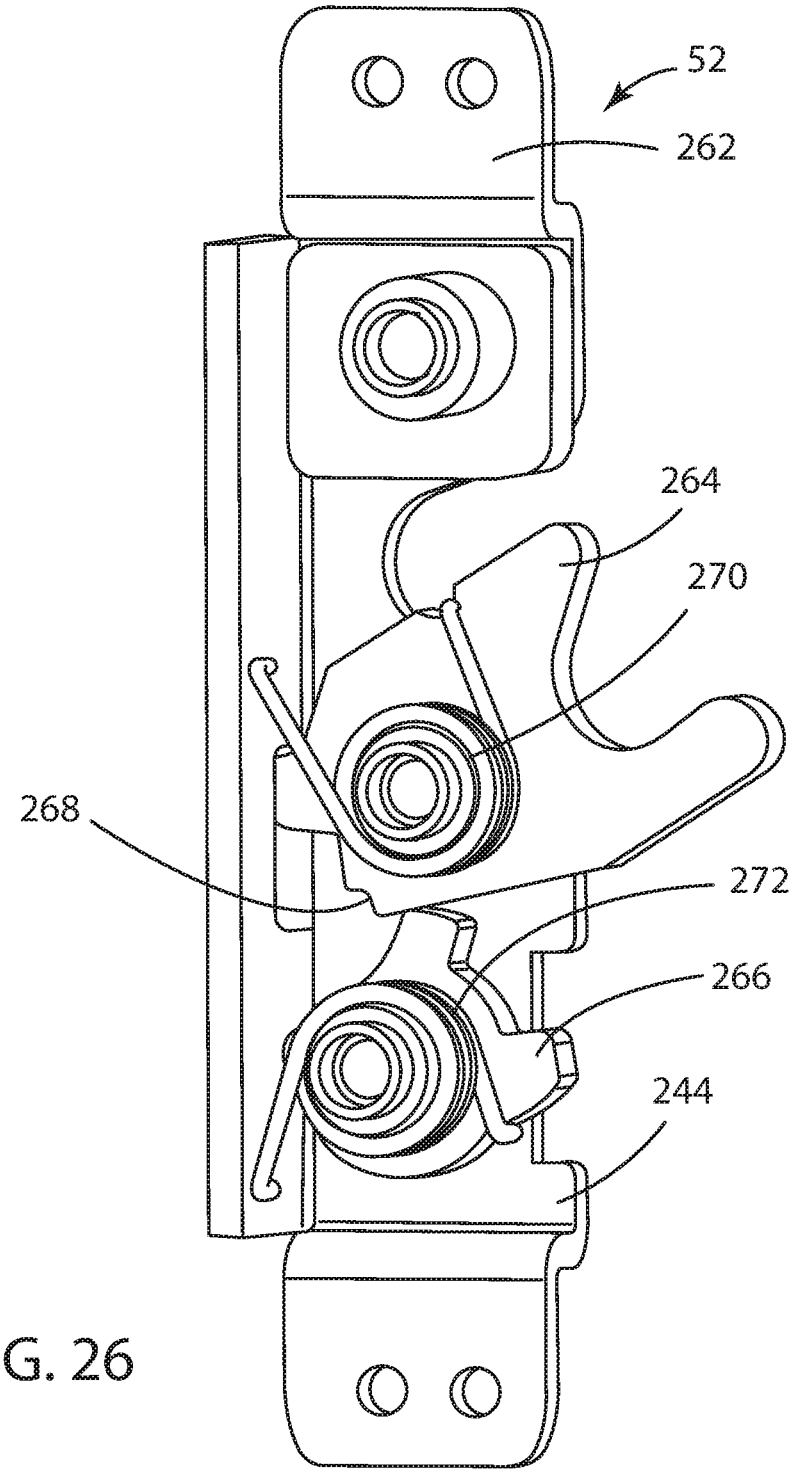
FIG. 26 is a perspective view of the lock pawl and trigger in the unlatched position.
Figure 27:
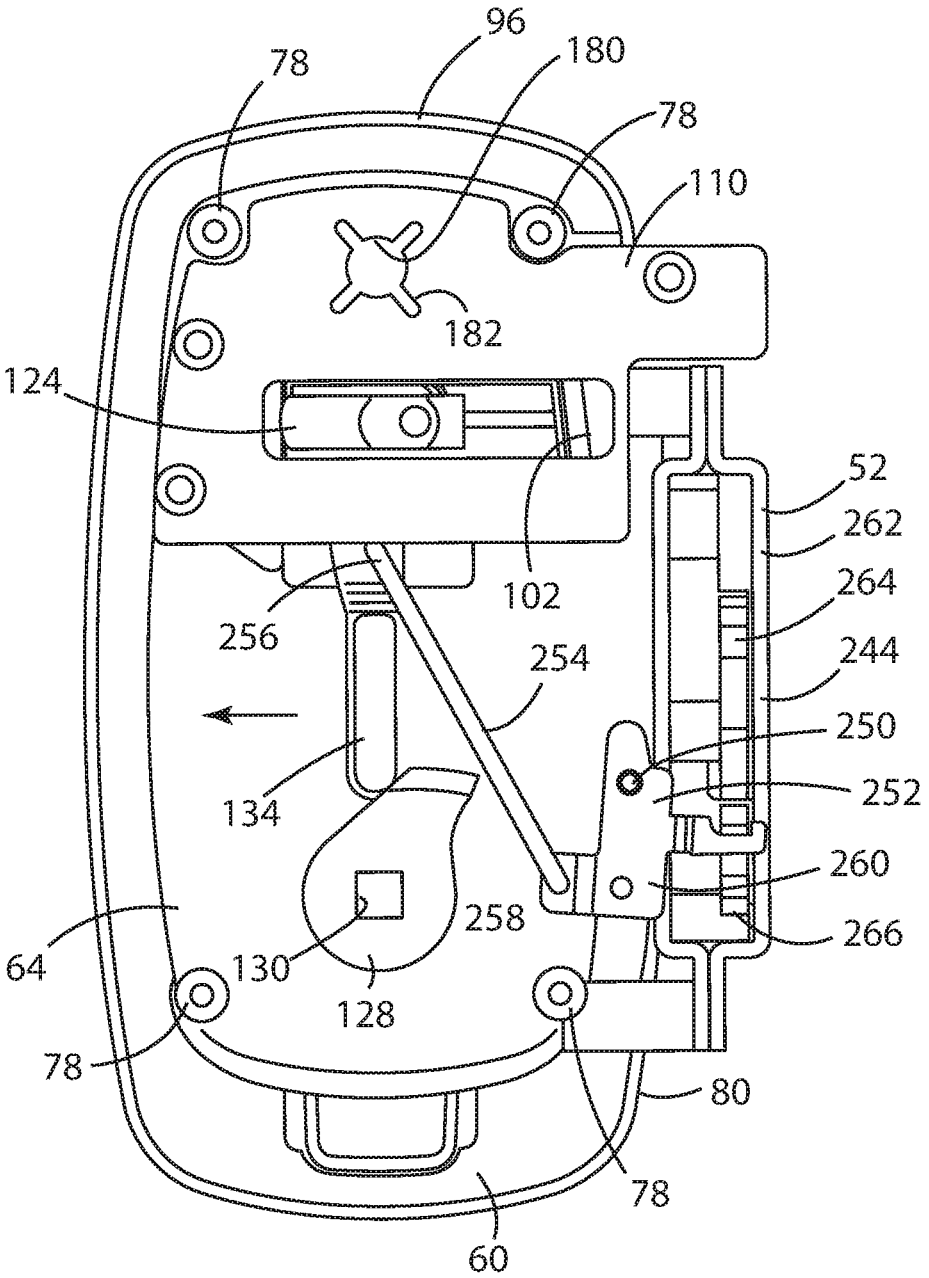
FIG. 27 is an interior elevation view of the inner face of the outside housing of the third embodiment of the latch assembly of the present disclosure, shown with the door latch in the latched position and the deadbolt in the unlatched position.
Figure 28:
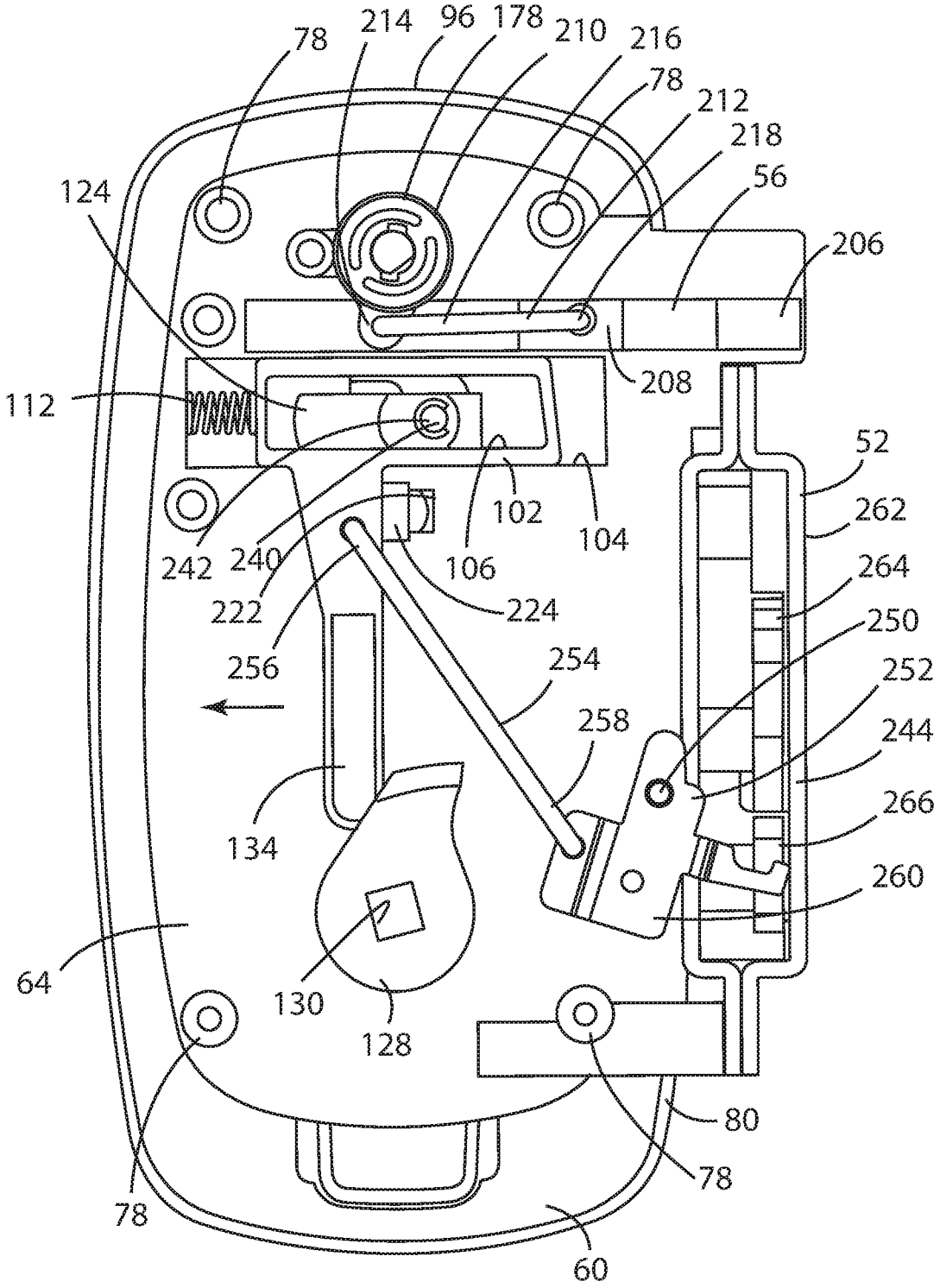
FIG. 28 is an interior elevation view of the inner face of the outside housing of the third embodiment of the latch assembly of the present disclosure, shown with the door latch and deadbolt in the unlatched position.

The rotary latch assembly 244 may also include a first torsion spring 270 that urges the lock pawl 264 to the unlocked position and a second torsion spring 272 that urges the trigger 266 to the locked position, as shown in FIG. 26. Shifting the entry door 20 from the open position to the closed position causes the lock pawl 264 to engage the door striker 246, which rotates the lock pawl 264 to the locked position against the urging of the first torsion spring 270 and allows the trigger 266 to reengage the detent 268 on the lock pawl 264 under the urging of the second torsion spring 272, thereby maintaining the lock pawl in the locked position.

In accordance with the third embodiment of the latch assembly 40 of the present disclosure, the use of a rotary latch assembly 244 has been found to be advantageous in that replacement of the spring bolt 54 utilized with the first and second embodiments described above with a rotary latch assembly 244 allows use of many common components to lower tooling and production costs. This interchangeability also provides the option to the door manufacturer and subsequent OEM to offer two different latching systems (a spring bolt 54 or a rotary latch assembly 244) that otherwise look identical from the exterior or interior of the entry door 20. Once the plunger 102 is actuated either by shifting of the external lever handle 82 from the retracted to the extended position or by rotation of the interior door release control 92, the rotary latch cam 248 rotates and moves the trigger 266 to release the lock pawl 264.

Furthermore, a latch assembly 40 having a door latch 52 configured as spring bolt 54 may be desired for lower cost applications, while the rotary latch assembly 244 may be desired for motorized applications. That is, a feature of the use of the rotary latch assembly 244 is the second link 254 from the interior plunger arm 134 to the rotary latch cam 248. While the rotary latch assembly 244 of the third embodiment of the present disclosure is illustrated as attached to the latch assembly 40 by installing a different link, the rotary latch assembly 244 may be remotely activated for doors in which the latch assembly 40 is installed further inboard of the door edge.

As applied to any of the foregoing embodiments, it has been determined that water control is important to the continued function and durability of the latch assembly 40. More particularly, it has been found desirable to provide features to provide such water control to minimize infiltration of water into the interior of the latch assembly 40.

Water control may be obtained by the use of water diversion provided on the outer face 66 of the outside housing 60. Preferably, an upper portion of the outer face 66 of the outside housing 60 comprises a raised portion 274 to divert water around the outside housing 60. The water diversion also includes the inner edges 276 of the external lever handle 82 having parallel grooves 278 disposed therein and the outer face 66 of the outside housing 60 proximate the first end 84 of the external lever handle 82 having a pair of outwardly facing walls 280 that engage the grooves 278 disposed on the external lever handle 82 when the external lever handle 82 is in the retracted position. Further, the lock aperture 98 through the outside housing 60 through which the external lock cylinder 100 extends may be disposed above the external lever handle 82 and may include a raised portion 282 to divert water around the outside housing 60 and away from the external lever handle 82. Finally, ribs 284 may be disposed about the upper recess 220 within which the first end 84 of the external lever handle 82 is received to divert water from the latch assembly 40.

Finally, the latch assembly 40 as described in any of the foregoing embodiments may be constructed of injection molded components. In particular, the outside housing 60, inside plate 62, external lever handle 82, interior door release control 92, deadbolt knob 186, and night lock knob 202 may be advantageously constructed of injection molding resins. Such resins can include polymers, such as glass filled nylon.

In accordance with the foregoing description, it will be readily appreciated by those skilled in the art that modifications may be made to the invention without departing from the concepts disclosed herein. Such modifications are to be considered as included in the following claims, unless these claims by their language expressly state otherwise.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the terms "coupled" (in all of its forms, couple, coupling, coupled, etc.) and "connected" (in all of its forms, connect, connecting, connected, etc.) generally mean the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "operably connected" generally means that one component functions with respect to another component, even if there are other components located between the first and second component, and the term "operable" defines a functional relationship between components.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the inner faces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structure without departing from the concepts of the present invention, and further it is to be understood that such concepts are intended to be covered by the following claims unless these claims by their language expressly state otherwise.

The invention claimed is as follows:

1. A latch assembly adapted for mounting adjacent an associated closure of the type that can be shifted between an open position and a closed position, the latch assembly comprising:

an outside housing having an inner face and an outer face;

a door latch disposed proximate a side of the outside housing and adapted to engage a jamb section of a door opening, the door latch having a door open position and a door closed position;

an external lever handle having a first end and a second end, wherein the first end is operably coupled with the door latch and the second end is pivotally mounted on the outer face of the outside housing for rotation of the external lever handle between a retracted position and an extended position;

a plunger slidingly received within a plunger recess disposed proximate the inner face of the outside housing and operably connected with the door latch, wherein the plunger has a latched position and an unlatched position within the plunger recess and comprises a longitudinal slot within which a plunger cam surface is disposed;

a resilient member operably coupled with the plunger and urging the plunger to the latched position; and a handle cam operably coupled with the first end of the external lever handle, wherein the handle cam is received within the longitudinal slot of the plunger and the handle cam comprises a handle cam surface juxtaposed against and in sliding relation with the plunger cam surface;

wherein the plunger is maintained in the latched position when the external lever handle is in the retracted position by the resilient member, whereby the closure cannot be unintentionally shifted from the closed position, and the plunger is displaced from the latched position to the unlatched position when the external lever handle is displaced from the retracted position to the extended position by the handle cam surface of the handle cam bearing against the plunger cam surface, whereby the closure is free to be shifted from the closed position to the open position.

2. The latch assembly as set forth in claim 1, further comprising an inside plate having an inner face and an outer face, an interior door release control mounted proximate to the outer face of the inside plate, a cam operably coupled with the interior door release control, and an interior plunger arm operably coupled with the plunger, wherein operation of the interior door release control urges the cam against the interior plunger arm to displace the plunger from the latched position and an unlatched position.

3. The latch assembly as set forth in claim 2, wherein the interior door release control is a rotatable lever.

4. The latch assembly as set forth in claim 2, wherein the interior plunger arm is integral with the plunger and depends therefrom in a substantially perpendicular direction relative to the longitudinal slot.

5. The latch assembly as set forth in claim 2, wherein the longitudinal slot is wider than the handle cam.

6. The latch assembly as set forth in claim 1, wherein the outer face of the outside housing further comprises a recess within which the second end of the external lever handle is received and a hinge pin extends across the recess and through an opening in the second end of the external lever handle to pivotally mount the external lever handle on the outer face of the outside housing for rotation of the external lever handle between the retracted position and the extended position.

7. The latch assembly as set forth in claim 1, further comprising a plate mounted to the inner face of the outside housing, wherein the plunger is disposed between the outside housing and the plate, and the plunger is restrained within the plunger recess.

8. The latch assembly as set forth in of claim 1, wherein an upper portion of the outside housing comprises a raised portion to divert water around the outside housing.

9. The latch assembly as set forth in claim 1, wherein the resilient member comprises a compression spring having a first end received within a cylindrical cavity disposed within an end of the plunger and a second end abutting a terminal wall of the plunger recess opposite the end of the plunger.

10. The latch assembly as set forth in claim 1, wherein the plunger recess is integrally formed on the inner face of the outside housing.

11. The latch assembly as set forth in claim 1, wherein the handle cam has a distal end proximate the cam surface and the first end of the external lever handle is operably coupled to the handle cam by a threaded fastener extending through an orifice in the handle cam and threadingly received within a threaded opening in the first end of the external lever handle.

12. The latch assembly as set forth in claim 11, wherein the orifice in the handle cam is provided with a shoulder upon which a head of the threaded fastener is disposed.

13. The latch assembly as set forth in claim 1, wherein the door latch comprises a spring bolt integrated with the plunger.

14. The latch assembly as set forth in claim 13, wherein the plunger recess and the longitudinal slot are perpendicular with the doorjamb and the spring bolt integrated with the plunger slides in a direction perpendicular with the jamb section of the door opening.

15. The latch assembly as set forth in claim 14, wherein the spring bolt has an outer end that extends exterior of the outside housing for engagement with an associated latch strike having a door strike recess and an inner end thereof which extends interior of the housing, the outer end of the spring bolt further having a first inclined surface that faces the door strike recess on the strike when the closure is in the open position.

16. A latch assembly as set forth in claim 15, where the outer end of the spring bolt has a second inclined surface that extends outwardly toward the exterior of the housing at about 4 degrees relative a longitudinal length of the spring bolt.

17. The latch assembly as set forth in claim 1, further comprising:

an orifice through the outside housing through which a lock cylinder extends from the outer face, the lock cylinder having a locked condition and an unlocked condition;

a deadbolt clutch operably and rotatably coupled with the lock cylinder;

a cam gear operably and rotatably coupled with the deadbolt clutch; and a lock bolt rack operably coupled with the cam gear and slidably retained within a rack slot transverse to the plunger recess within which the plunger is shiftingly received;

wherein rotation of the lock cylinder from the unlocked condition to the lock condition slides the lock bolt rack to a locked position within the rack slot, whereby the lock bolt rack engages a notch in the plunger to prevent shifting of the plunger from the latched position to the unlatched position, and rotation of the lock cylinder from the locked condition to the unlocked condition slides the lock bolt rack to an unlocked position, whereby the lock bolt rack disengages the notch in the plunger to allow shifting of the plunger from the latched position to the unlatched position.

18. The latch assembly as set forth in of claim 17, wherein the orifice through the outside housing through which the lock cylinder extends is disposed above the external lever handle and comprises a raised portion to divert water around the outside housing and away from the external lever handle.

19. The latch assembly as set forth in claim 17, further comprising a deadbolt clutch spring disposed between and inside a plate mounted to the inner face of the outside housing and the cam gear, the plate further comprising an opening through which the cam gear extends and a plurality of symmetrically arranged radial slots that engage opposed radial detents disposed on the deadbolt clutch spring.

20. The latch assembly as set forth in claim 17, further comprising:

an inside plate having an inner face and an outer face; and a deadbolt knob mounted proximate to the outer face of the inside plate, the deadbolt knob having a locked position and an unlocked position and being operably and rotatably coupled with the lock cylinder, wherein operation of the deadbolt from the unlocked position to the locked position slides the lock bolt rack to the locked position within the rack slot, whereby the lock bolt rack engages a notch in the plunger to prevent shifting of the plunger from the latched position to the unlatched position, and rotation of the deadbolt knob from the locked condition to the unlocked condition slides the lock bolt rack to an unlocked position, whereby the lock bolt rack disengages the notch in the plunger to allow shifting of the plunger from the latched position to the unlatched position.

21. The latch assembly as set forth in claim 20, wherein the deadbolt clutch allows independent rotation of the deadbolt knob relative the lock cylinder.

22. The latch assembly as set forth in claim 1, further comprising:

an inside plate having an inner face and an outer face;

an inwardly extending tab disposed on the plunger proximate the inner face of the inside plate;

an arcuate slot extending through the inside plate, the arcuate slot comprising a first end aligned with the plunger recess and plunger and a second end not aligned with the plunger recess and plunger; and a night lock knob extending through and shiftingly restrained in the arcuate slot, the night lock knob having a locked position and an unlocked position;

wherein shifting the night lock knob to the locked position rack engages the night lock knob with the inwardly extending tab disposed on the plunger to prevent shifting of the plunger from the latched position to the unlatched position, and shifting the night lock knob to the unlocked position disengages the night lock knob from the inwardly extending tab disposed on the plunger to allow shifting of the plunger from the latched position to the unlatched position.

23. The latch assembly as set forth in claim 22, wherein the night lock knob is slidably restrained in the arcuate slot by lock washer.

24. The latch assembly as set forth in claim 1, wherein a pair of inner edges of the external lever handle includes parallel grooves disposed therein and the outer face of the outside housing proximate the first end of the external lever handle includes a pair of outwardly facing walls that engage the grooves disposed on the external lever handle when the external lever handle is in the retracted position.

25. The latch assembly as set forth in claim 1, further comprising a deadbolt movably mounted in the outside housing for shifting between a locked position, wherein the closure is positively retained in the closed position, and an unlocked position, wherein the closure is free to be shifted between the open and closed positions.

26. The latch assembly as set forth in claim 25, wherein the deadbolt is slidably mounted in the outside housing with an outer end thereof which extends exterior of the outside housing for engagement with an associated strike adjacent the closure and an inner end thereof which extends interior of the outside housing, the latch assembly further comprising:

an orifice through the outside housing through which an external lock cylinder extends from the outer face, the external lock cylinder having a locked condition and an unlocked condition;

a deadbolt cam operably and rotatably coupled with the external lock cylinder; and a first link having a first end thereof pivotally connected with the inner end of the deadbolt and a second end thereof pivotally connected with a crank arm of a deadbolt cam, such that actuation of the external lock cylinder between the locked and unlocked positions longitudinally shifts the deadbolt between the locked and unlocked positions.

27. A latch assembly as set forth in claim 25, wherein the door latch comprises a spring bolt integrated with the plunger and the deadbolt has a cross-sectional lateral thickness that is narrower than a cross-sectional lateral thickness of the spring bolt.

28. A latch assembly as set forth in claim 26, wherein the outer end of the deadbolt is tapered.

29. The latch assembly as set forth in claim 1, wherein the outer face of the outside housing comprises an upper recess within which the first end of the external lever handle is received, the upper recess further comprising an elongated slot, and the first end of the external lever handle comprises a lever lock bolt having a locked position and an unlocked position, the lever lock bolt being received within the elongated slot when in the unlocked position and being retained within the elongated slot when in the locked position.

30. The latch assembly of claim 29, wherein the locked position of the lever lock bolt is rotationally 90° relative the unlocked position of the lever lock bolt.

31. The latch assembly of claim 29, further comprising ribs disposed about the upper recess within which the first end of the external lever handle is received to divert water from the latch assembly.

32. The latch assembly as set forth in claim 31, wherein the first end of the external lever handle further comprises an orifice through which a handle lock cylinder extends, the handle lock cylinder having a locked condition and an unlocked condition, and further comprising:

a clutch disposed on an outside end of the lever lock bolt operably and rotatably coupled with the handle lock cylinder, through which the handle lock cylinder is operably coupled with the lock lever bolt; and a clutch holder by which the lever lock bolt is mounted to the first end of the external lever handle.

33. The latch assembly as set forth in claim 32, wherein the handle lock cylinder is master keyed for dealer convenience.

34. The latch assembly as set forth in claim 1, wherein the handle cam has a distal end proximate the handle cam surface and the first end of the external lever handle is operably coupled to the handle cam by a handle shaft fixedly mounted in the first end of the external lever handle and extending through and fixed within an orifice in the handle cam.

35. The latch assembly as set forth in claim 34, wherein the handle shaft further comprises a notch disposed at a distal end thereof and is fixed within the orifice in the handle cam by a C-clamp received in the notch.

36. The latch assembly as set forth in claim 34, wherein the external lever handle is injection molded and the handle shaft is fixedly mounted in the first end of the external lever handle during a molding process.

37. The latch assembly as set forth in claim 1, wherein the door latch comprises a rotary latch assembly having a locked position and an unlocked position and a door striker is disposed on the jamb section of the door opening for engagement with the rotary latch assembly.

38. The latch assembly as set forth in claim 37, further comprising:

a rotary latch cam pivotably mounted at a first end to the inner face of the outside housing proximate the rotary latch assembly; and a second link having a first end thereof pivotally and operably connected with the plunger and a second end thereof pivotally and operably connected with a second end of the rotary latch cam, such that shifting the plunger to the unlatched position rotates the rotary latch cam to shift the rotary latch assembly between the locked and unlocked positions.

39. The latch assembly as set forth in claim 38, wherein the rotary latch assembly comprises a frame attached to an edge of the outside housing, a lock pawl rotatably mounted to the frame and having a locked position in engagement with the door striker and an unlocked position, and a trigger rotatably mounted to the frame and operably coupled with a detent on the lock pawl and the rotary latch cam, the trigger having a locked position and an unlocked position:

wherein the rotary latch cam rotates the trigger from the locked position to the unlocked position when the plunger slides from the latched position to the unlatched position and the lock pawl is released to the unlocked position.

40. The latch assembly as set forth in claim 39, wherein the rotary latch assembly further comprises a first torsion spring that urges the lock pawl to the unlocked position and a second torsion spring that urges the trigger to the locked position.

41. The latch assembly as set forth in claim 40, wherein shifting the closure from the open position to the closed position rotates the lock pawl to the locked position against the urging of the first torsion spring and allows the trigger to reengage the detent on the lock pawl under the urging of the second torsion spring, thereby maintaining the lock pawl in the locked position.

42. The latch assembly as set forth in claim 38, further comprising an interior plunger arm integral with the plunger and depending therefrom in a substantially perpendicular direction relative to the longitudinal slot, wherein the first end of the second link is operably coupled with the interior plunger arm.

43. A latch assembly adapted for mounting adjacent an associated closure of the type that can be shifted between an open position and a closed position, the latch assembly comprising:

an outside housing having inner face and an outer face;

a door latch disposed proximate a side of the outside housing and adapted to engage a jamb section of a door opening, the door latch having a door open position and a door closed position;

an external lever handle having a first end and a second end, wherein the first end is operably coupled with the door latch and the second end is pivotally mounted on the outer face of the outside housing for rotation of the external lever handle between a retracted position and an extended position;

a plunger slidingly received within a plunger recess operably coupled with the inner face of the outside housing and operably connected with the door latch, wherein the plunger has a latched position and an unlatched position within the plunger recess;

a resilient member operably coupled with the plunger and urging the plunger to the latched position; and a handle cam operably coupled with the first end of the external lever handle, wherein the handle cam is operably coupled with the plunger and the handle cam comprises a handle cam surface juxtaposed against and in abutting relation with the plunger;

wherein the plunger is maintained in the latched position when the external lever handle is in the retracted position by the resilient member, whereby the closure cannot be unintentionally shifted from the closed position, and the plunger is displaced from the latched position to the unlatched position when the external lever handle is displaced from the retracted position to the extended position by the cam surface of the handle cam bearing against the plunger, whereby the closure is free to be shifted from the closed position to the open position.

44. The latch assembly of claim 43, wherein the handle cam comprises an inclined plane relative the plunger.

45. The latch assembly of claim 44, wherein the plunger comprises a plunger cam surface against which the inclined plane of the handle cam is disposed to urge the plunger to the unlatched position within the plunger recess upon displacement of the external lever handle from the retracted position to the extended position.

46. A latch assembly adapted for mounting adjacent an associated closure of the type that can be shifted between an open position and a closed position, the latch assembly comprising:

an outside housing having inner face and an outer face;

a door latch disposed proximate a side of the outside housing and adapted to engage a jamb section of a door opening, the door latch having a door open position and a door closed position;

an external lever handle having a first end and a second end, wherein the first end is operably coupled with the door latch and the second end is pivotally mounted on the outer face of the outside housing for rotation of the external lever handle between a retracted position and an extended position;

a plunger slidingly received within a plunger recess operably coupled with the inner face of the outside housing and operably connected with the door latch, wherein the plunger has a latched position and an unlatched position within the plunger recess and comprises a plunger cam surface;

a resilient member operably coupled with the plunger and urging the plunger to the latched position; and a handle cam operably coupled with the first end of the external lever handle, wherein the handle cam is operably coupled with the plunger and the handle cam comprises a handle cam surface juxtaposed against and in abutting relation with the plunger cam surface;

wherein the plunger is maintained in the latched position when the external lever handle is in the retracted position by the resilient member, whereby the closure cannot be unintentionally shifted from the closed position, and the plunger is displaced from the latched position to the unlatched position when the external lever handle is displaced from the retracted position to the extended position by the cam surface of the handle cam bearing against the plunger, whereby the closure is free to be shifted from the closed position to the open position.

* * * * *